US007789497B2

(12) United States Patent
Taira et al.

(10) Patent No.: US 7,789,497 B2
(45) Date of Patent: Sep. 7, 2010

(54) INK-JET HEAD

(75) Inventors: Hiroshi Taira, Ichinomiya (JP); Yoshirou Kita, Nagoya (JP); Tadanobu Chikamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 608 days.

(21) Appl. No.: 11/691,087

(22) Filed: Mar. 26, 2007

(65) Prior Publication Data

US 2007/0229607 A1 Oct. 4, 2007

(30) Foreign Application Priority Data

Mar. 31, 2006 (JP) ..... 2006-097264

(51) Int. Cl.
*B41J 2/045* (2006.01)
*B41J 2/14* (2006.01)

(52) U.S. Cl. ..... 347/71; 347/50

(58) Field of Classification Search ..... 347/50, 347/58, 68–72

See application file for complete search history.

(56) References Cited

U.S. PATENT DOCUMENTS

| | | | | |
|---|---|---|---|---|
| 2004/0183867 | A1* | 9/2004 | Hirota | 347/68 |
| 2006/0017779 | A1 | 1/2006 | Ito | |
| 2006/0044363 | A1* | 3/2006 | Katayama | 347/71 |

FOREIGN PATENT DOCUMENTS

| | | | |
|---|---|---|---|
| JP | H09-148484 | A | 6/1997 |
| JP | 2003-220696 | A | 8/2003 |
| JP | 2005-246903 | A | 9/2005 |
| JP | 2006-035584 | A | 2/2006 |

OTHER PUBLICATIONS

Japan Patent Office; Notice of Reasons for Rejection in Japanese Patent Application No. 2007-053256 (counterpart to the above-captioned U.S. patent application) mailed Jun. 15, 2010 (abridged translation).

* cited by examiner

*Primary Examiner*—Stephen D Meier
*Assistant Examiner*—Geoffrey Mruk
(74) *Attorney, Agent, or Firm*—Baker Botts, LLP.

(57) ABSTRACT

There are provided an ejection actuator that ejects ink from a nozzle, and a driver chip that supplies a signal for driving the ejection actuator. In a first location, the driver chip is sandwiched between a flat plate member and an elastic member. The elastic member biases the driver chip to the flat plate member. The elastic member is supported by the support member. A restricting portion is provided on at least either one of the support member and the flat plate member. When the support member and the flat plate member get close to each other in a second location different from the first location, the restricting portion restricts movement of at least either one of the support member and the flat plate member so as to prevent the driver chip and the support member in the first location from getting closer to each other beyond a minimum distance. Here, the minimum distance means a distance between the support member and the flat plate member in the first location at the time when the elastic member is compressed to the maximum limit.

14 Claims, 13 Drawing Sheets

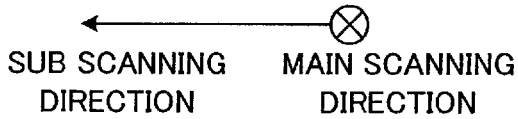
FIG. 12A
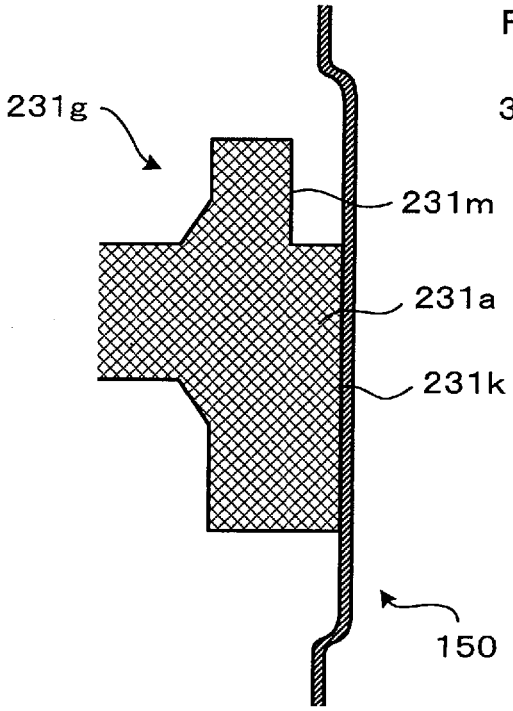
FIG. 12B
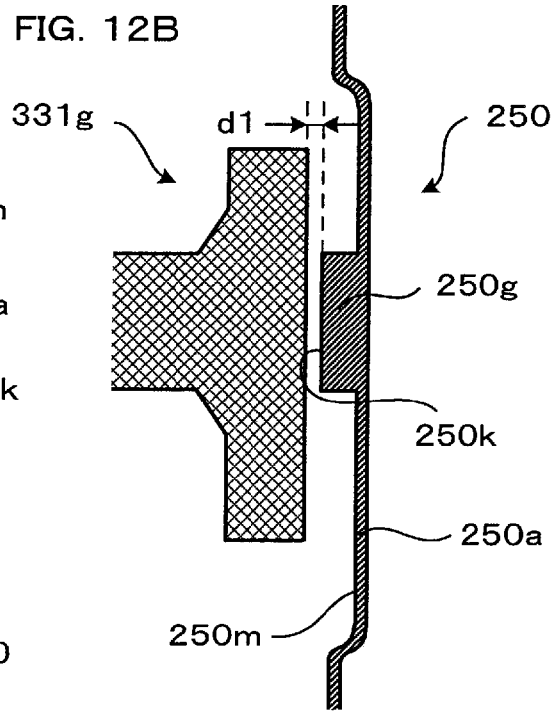
FIG. 12C
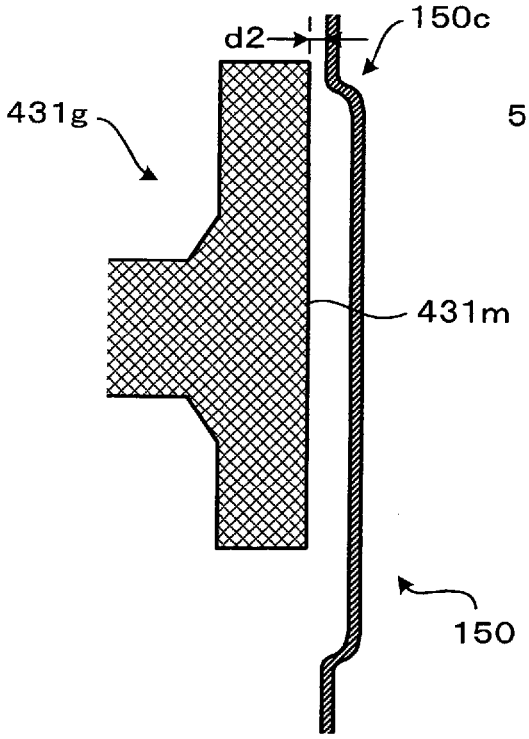
FIG. 12D
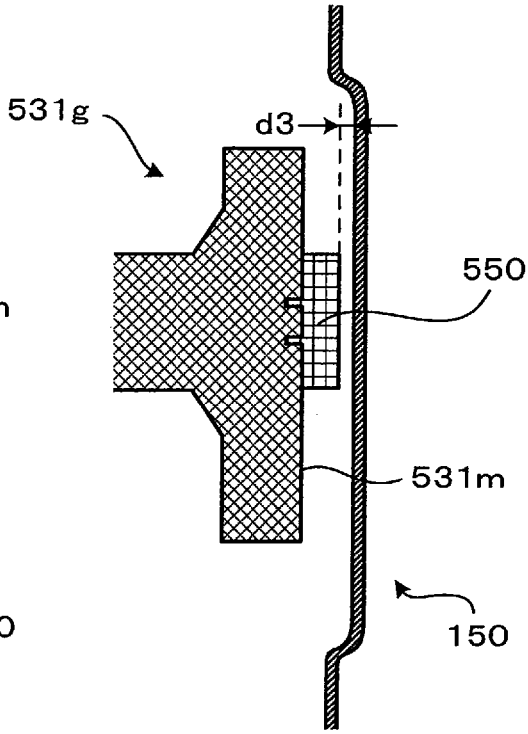

INK-JET HEAD

CROSS-REFERENCE TO RELATED APPLICATIONS

This application claims the benefit of Japanese Patent Application No. 2006-097264, filed Mar. 31, 2006, the disclosure of which is incorporated herein by reference.

BACKGROUND OF THE INVENTION

1. Field of the Invention

The present invention relates to an ink-jet head, and particularly to an ink-jet head including a driver chip that supplies a signal to an ejection actuator for ejecting ink from a nozzle.

2. Description of Related Art

Examples of an ink-jet head that ejects ink from a nozzle include one disclosed in Japanese Unexamined Patent Publication No. 2006-35584. The ink-jet head disclosed in Japanese Unexamined Patent Publication No. 2006-35584 includes an ejection actuator that ejects ink from a nozzle and a driver chip that supplies a signal to the ejection actuator.

There are various possible arrangements for a driver chip within an ink-jet head, one example of which is shown in FIG. 3A. In FIG. 3A, a driver chip (i.e., a driver IC 160) is sandwiched between a support member (i.e., an ink reservoir 131) and a plate member (i.e., a heat sink 150) with an elastic member (i.e., an elastic member 161) being interposed.

An ink-jet head having such a construction may, when for example it is installed in a printer or the like, be gripped by a human hand or a manufacturing device across a sub scanning direction indicated in FIG. 3. In such a case, the plate member and the support member get closer to each other and the elastic member is compressed. When the elastic member is compressed to the maximum limit, load on the driver chip sandwiched between the support member and the plate member via the elastic member rapidly increases, which may cause damage to the driver chip.

SUMMARY OF THE INVENTION

An object of the present invention is to provide an ink-jet head that, when gripped by a human hand or the like, can restrain an elastic member disposed in contact with a driver chip from being compressed to the maximum limit, and thereby can make it difficult for the driver chip to receive excessive load.

According to an aspect of the present invention, there is provided an ink-jet head including a passage unit, an ejection actuator, a driver chip, a flat plate member, an elastic member, and a support member. The passage unit has a nozzle. In the passage unit, an ink passage communicating with the nozzle is formed. The ejection actuator ejects, from the nozzle, ink contained in the ink passage formed in the passage unit. The driver chip supplies to the ejection actuator a signal for driving the ejection actuator. The flat plate member is in contact with the driver chip. The elastic member biases the driver chip to the flat plate member. The support member supports the elastic member and cooperates with the flat plate member to, in a first location, sandwich the driver chip therebetween with interposition of the elastic member. A restricting portion is provided on at least either one of the support member and the flat plate member in a second location which is different from the first location. When external force is applied to the flat plate member to thereby cause the flat plate member to get close to the support member in the first location, the restricting portion restricts relative movement between the support member and the flat plate member so as to prevent a distance between the flat member and the support member in the first location from becoming equal to or smaller than a minimum distance which is a distance therebetween in a state where the elastic member is compressed to the maximum limit.

In the aspect, there is the restricting portion that restricts movement of at least either one of the flat plate member and the support member so as to prevent the flat plate member and the support member from getting closer to each other beyond the distance therebetween in a state where the driver chip and the support member compress the elastic member to the maximum limit. Therefore, application of such load as to damage the driver chip can be prevented.

BRIEF DESCRIPTION OF THE DRAWINGS

Other and further objects, features and advantages of the invention will appear more fully from the following description taken in connection with the accompanying drawings in which:

FIGS. 12A to 12D show a heat sink and a supporter according to another embodiment different from the embodiment shown in FIG. 7.

DESCRIPTION OF THE PREFERRED EMBODIMENTS

In the following, some preferred embodiments of the present invention will be described.

Figure 1:
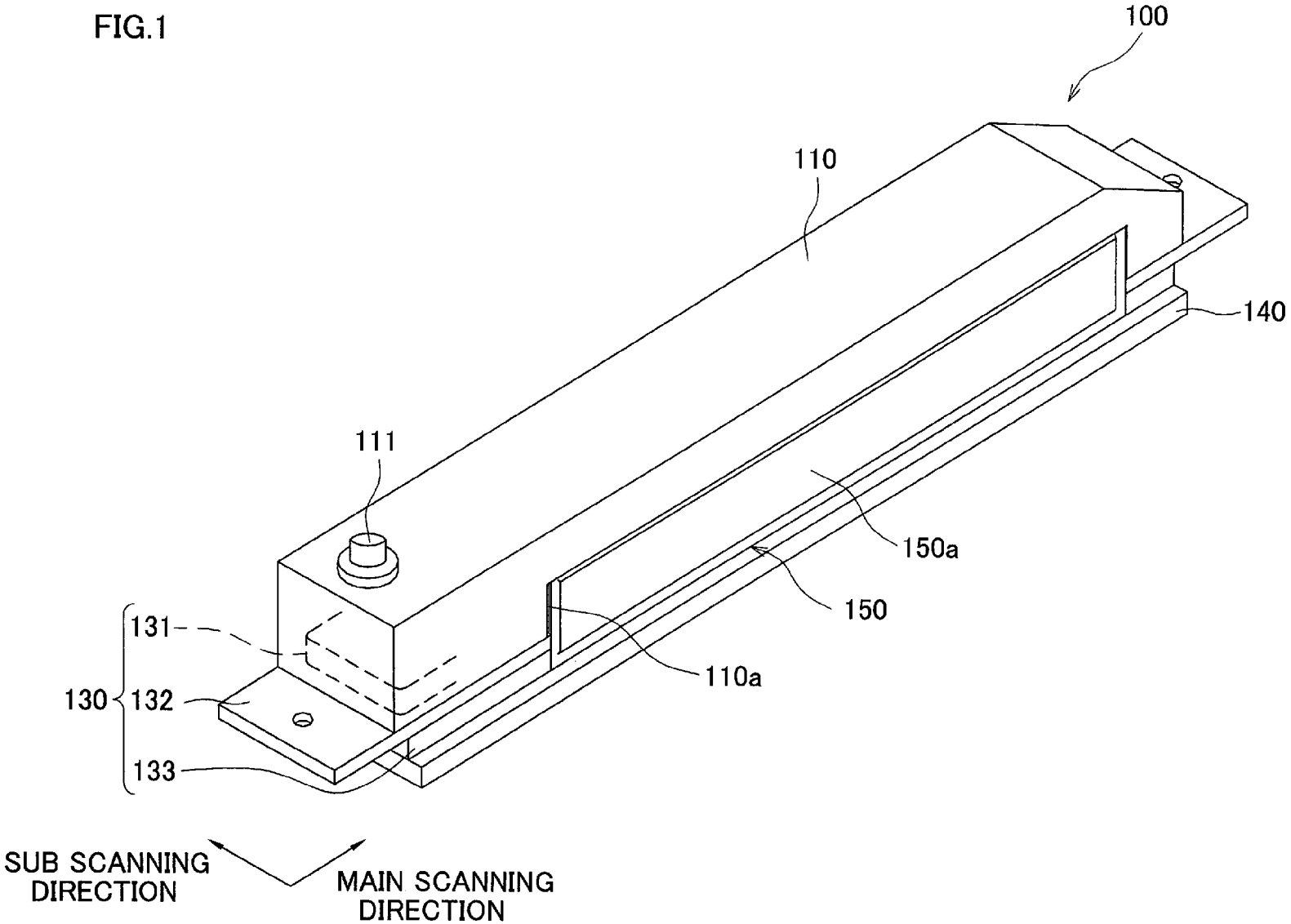
FIG. 1 is a perspective view showing an appearance of an ink-jet head according to an embodiment of the present invention.

FIG. 1 schematically illustrates a construction of an ink-jet head 100 according to an embodiment of the present invention. In a plan view, the ink-jet head 100 is elongated in one direction. Here, in this embodiment, a main scanning direction means a direction of elongation of the ink-jet head 100 in a plan view, and a sub scanning direction means a direction perpendicular to the main scanning direction in a plan view. In addition, a downward direction means a direction in which ink is ejected from the ink-jet head 100, and an upward direction means a direction opposite to the downward direction.

The ink-jet head 100 has a passage unit 140 and an ink reservoir 130. Nozzles 8 are formed on a lower face of the passage unit 140. The ink reservoir 130 supplies ink to the passage unit 140. The ink reservoir 130 is a layered body laminated with three plates. The ink reservoir 130 has an upper reservoir 131, a reservoir base 132, and a lower reservoir 133. In a plan view, any of the upper reservoir 131, the reservoir base 132, the lower reservoir 133, and the passage unit 140 has a substantially rectangular shape with its longer side extending along the main scanning direction. The upper reservoir 131, the reservoir base 132, the lower reservoir 133, and the passage unit 140 are put in layers in this order from up to down.

The ink-jet head 100 has a head covering 110. The head covering 110 has a substantially box-like shape that opens downward in its one face. The head covering 110 is placed on the reservoir base 132 so as to cover parts disposed on an upper face of the reservoir base 132, such as the upper reservoir 131. An ink supply valve 111 is provided on an upper face of the head covering 110. Through the ink supply valve 111, ink is supplied to an ink passage 135 that is formed within the ink reservoir 130. A detailed description of the ink passage 135 will be given later.

Two side faces of the head covering 110 are partially notched, and thus notches 110*a* are formed. The notch 110*a* is a missing portion of the head covering 110, which extends along an up-and-down direction of the head covering 110 from a lower end to a middle portion of the side face. The notch 110*a* has a rectangular shape, and its longer side is along the main scanning direction. A shorter side of the notch 110*a* is along an upward direction from the lower end of the side face of the head covering 110. From side faces of the ink-jet head 100 having the head covering 110 put thereon, inside of the head covering 110 appears outside through the notches 110*a*. A heat sink 150 is provided on the side face of the ink-jet head 100 and within the head covering 110. In this embodiment, through the notch 110*a*, a flat protrusion 150*a* formed on the heat sink 150 can be seen from outside of the head covering 110. A detailed description of the heat sink 150 will be given later.

The ink-jet head 100 is applicable to all of character/image recording apparatuses of ink-jet type, such as an ink-jet printer. For example, when applied to an ink-jet printer, the ink-jet head 100 is disposed with, in a plan view, its longer direction being along the main scanning direction and its shorter direction being along the sub scanning direction. When an image data is inputted from outside and a print paper is conveyed to a position opposed to the nozzles 8 formed on the lower face of the passage unit 140, ink is ejected from the nozzles 8 in accordance with a drive signal given from a drive element, so that a character, an image, or the like is formed on the print paper. Ink used in the ink-jet head 100 is for example supplied from an ink cartridge mounted on the ink-jet printer, through an ink tube connected to the ink supply valve 111.

Figure 2:
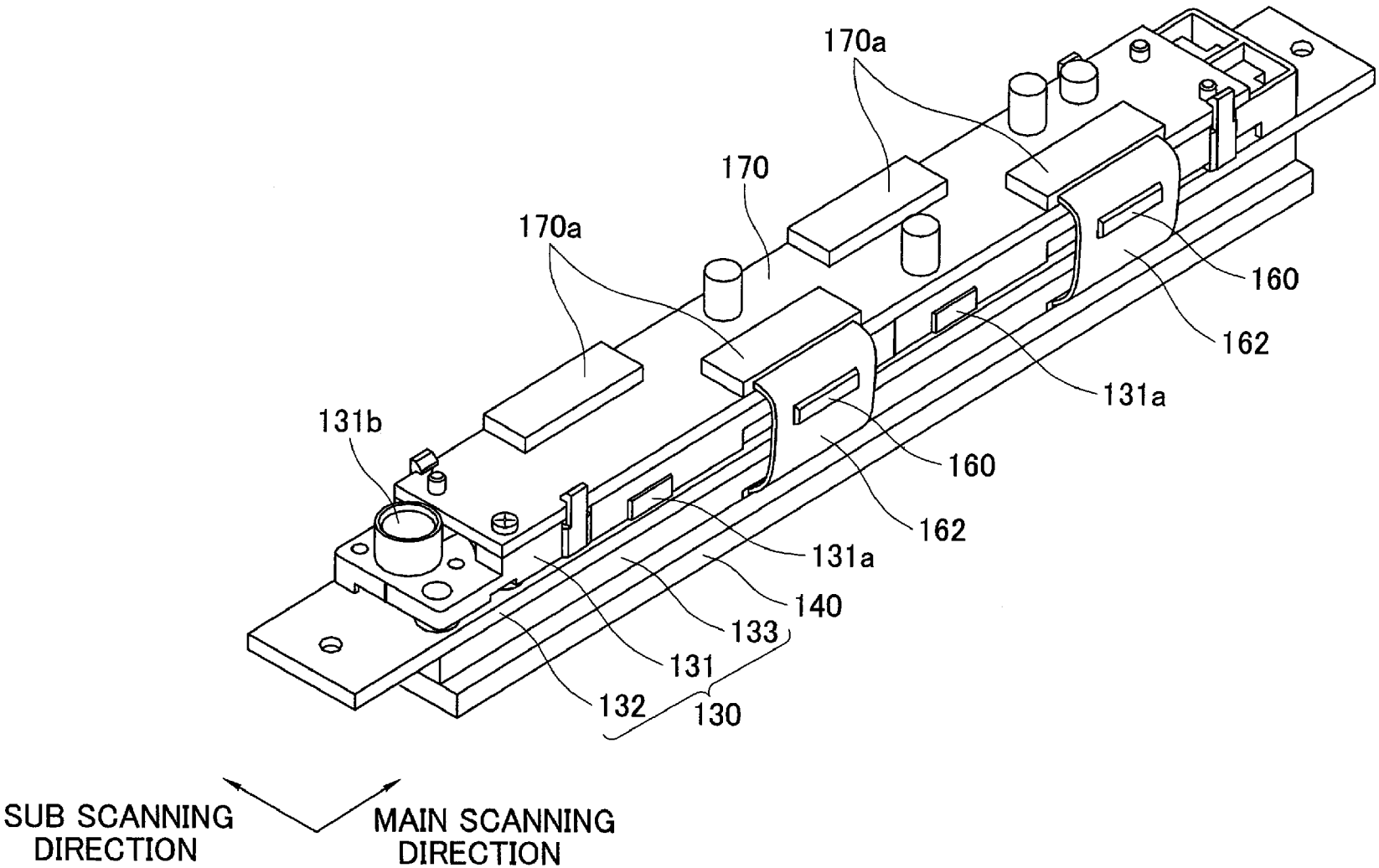
FIG. 2 is a perspective view showing an internal construction of the ink-jet head 1 shown in FIG. 1.

FIG. 2 is a perspective view of the ink-jet head 100 from which the head covering 110 and the heat sink 150 have been removed.

A control board 170 is fixed above the ink reservoir 130. The control board 170 has a substantially rectangular shape elongated in the main scanning direction. With respect to the sub scanning direction, a length of the control board 170 and a length of the upper reservoir 131 are substantially the equal. On an upper face of the control board 170, various electronic components such as an IC (Integrated Circuit) chip are fixed and many wires are provided. These electronic components and wires build various processors and memory devices on the control board 170. The memory device built on the control board 170 stores therein data indicating a program for controlling the ink-jet head 100 and data for a temporary job. Based on these data, the processor built on the control board 170 controls an operation of the ink-jet head 100.

Four connectors 170*a* are fixed on the upper face of the control board 170. The connectors 170*a* are electrically connected to various processors and memory devices built on the control board 170. Two of the connectors 170*a* are fixed on the control board 170 along one end of the control board 170 with respect to the sub scanning direction. The other two of the connectors 170*a* are fixed on the control board 170 along the other end of the control board 170 with respect to the sub scanning direction. The four connectors 170*a* are arranged on the control board 170 at regular intervals with respect to the main scanning direction in such a manner that they are not opposed to one another with respect to the sub scanning direction. In a plan view, the four connectors 170*a* are arranged in a zigzag pattern on the control board 170.

Four driver ICs 160 acting as a drive element are fixed to side faces of the ink reservoir 130 (including the upper reservoir 131, the reservoir base 132, and the lower reservoir 133) with respect to the sub scanning direction. The driver ICs 160 are fixed in vicinities of lower ends of the respective connectors 170*a*. Two of the driver ICs 160 are fixed on one side face of the upper reservoir 131 with respect to the sub scanning direction, and the other two of the driver ICs 160 are fixed on the other side face of the upper reservoir 131 with respect to the sub scanning direction.

One end of an FPC (Flexible Printed Circuit) 162 is connected to a side face of each connector 170*a*. The FPC 162 is a flexible sheet member, and has wires formed therein. The FPC 162 extends from the connector 170*a* downward along the side face of the ink reservoir 130, and reaches the lower reservoir 133. The other end of the FPC 162 is, through an opening formed on a side face of the lower reservoir 133, inserted between the lower reservoir 133 and the passage unit 140, and connected to a later-described actuator unit 120 that is bonded to an upper face of the passage unit 140.

Each of the four FPCs 162 has one driver IC 160 connected thereto. The driver IC 160 is, on a surface of each FPC 162, connected in a region between the connector 170*a* and the lower reservoir 133. The driver IC 160 is a bare chip that controls ejection of ink from the ink-jet head 100 as will be described later. The driver IC 160 is elongated with respect to the main scanning direction, and flat with respect to the sub scanning direction.

Restricting portions 131*a* are formed on both side faces of the ink reservoir 130 with respect to the sub scanning direction. The restricting portions 131*a* protrude from the side faces of the ink reservoir 131. Each of the side faces of the ink reservoir 130 has two restricting portions 131*a* formed thereon. The two restricting portions 131*a* formed on one side face are positioned in such a manner that, in a plan view, they are opposed to the two FPCs 162 extending along the other side face. That is, on each side face, the restricting portion 131*a* alternates with the FPCs 162 as well as the driver ICs 160 with respect to the main scanning direction.

An ink supply port 131*b* is formed on the upper face of the ink reservoir 130. The ink supply port 131*b* communicates with the ink supply valve 111 provided on the upper face of the head covering 110.

Figure 3A:
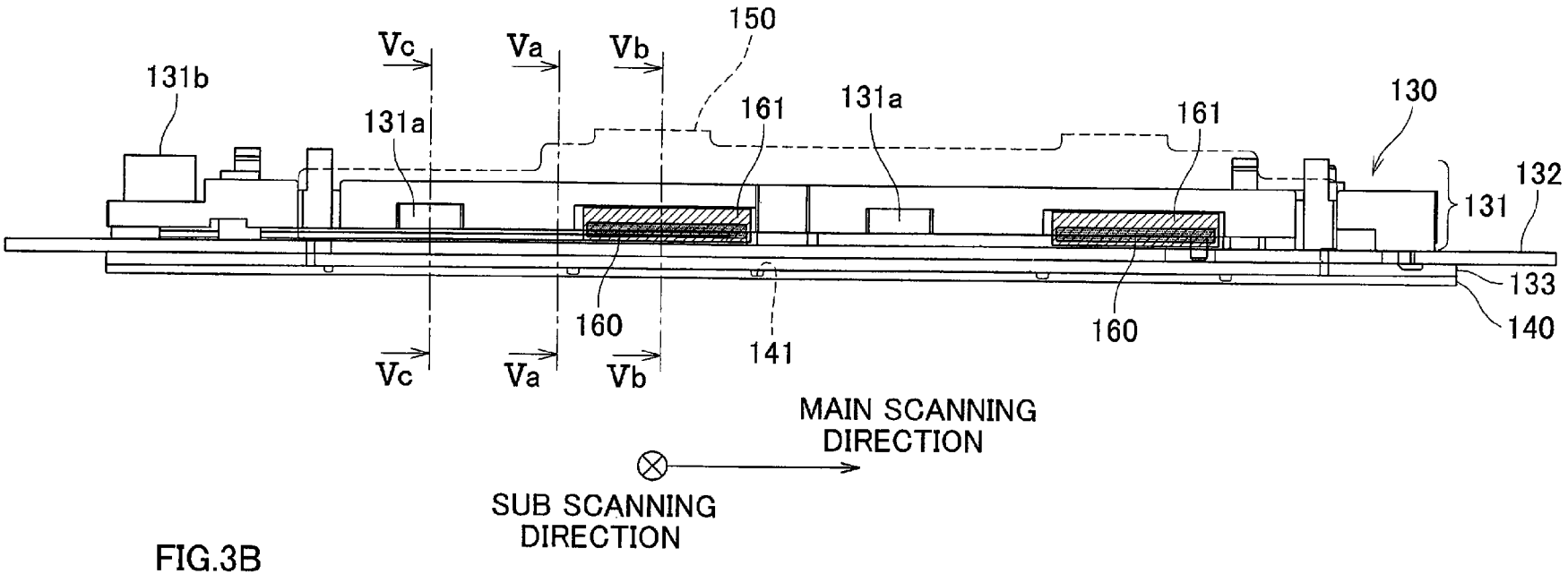
FIG. 3A is a side view showing an interior of the ink-jet head shown in FIG. 2.
Figure 3B:
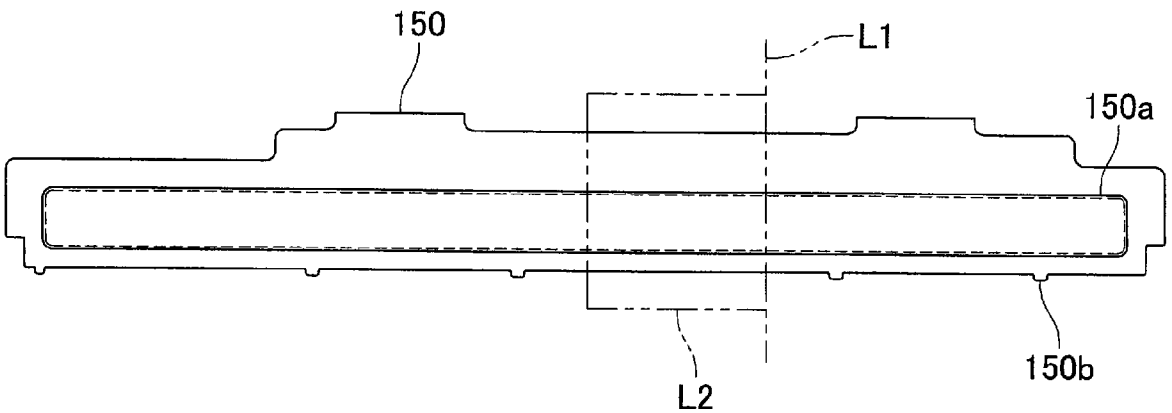
FIG. 3B is a side view of a heat sink shown in FIG. 2.

FIG. 3A is a side view of the ink-jet head 100 from which the head covering 110 has been removed. In FIG. 3A, the heat sink 150, the FPC 162, and the control board 170 have been removed. FIG. 3B shows the heat sink 150. In FIG. 3A, a location of the heat sink 150 as mounted on the ink-jet head 100 is illustrated with a broken line.

As shown in FIG. 3A, the two driver ICs 160 are fixed to the side face of the upper reservoir 131 with elastic members 161 therebetween. The ink supply port 131*b* is formed on an upper face of the upper reservoir 131.

The ink-jet head 100 has two heat sinks 150. The heat sink 150 is a flat-plate member made of a metal such as aluminum. Each of the two heat sinks 150 is provided at each end of the passage unit 140 with respect to the sub scanning direction, and extends along both the main scanning direction and the up-and-down direction. A surface of the heat sink 150 is opposed to the ink reservoir 130.

As shown in FIG. 3B, the heat sink 150 has a flat protrusion 150*a* and projections 150*b*. A closed region included in one surface of the heat sink 150 protrudes in the sub scanning direction, thereby forming the flat protrusion 150*a*. The flat protrusion 150*a* has a rectangular shape elongated in the main scanning direction as shown in FIG. 3B. The flat protrusion 150*a* is flat along the main scanning direction and along the up-and-down direction. The projections 150*b* projects downward from a lower end of the heat sink 150. At the lower end of the heat sink 150, five projections 150*b* is formed along the main scanning direction.

The surface of the heat sink 150 opposed to the ink reservoir 130 is partially opposed to the driver IC 160. Heat generated by the driver IC 160 transfers to the heat sink 150 via a contact face of the driver IC 160 with the heat sink 150. Thereby, heat dissipation from the driver IC 160 is enhanced. Here, a material of the heat sink 150 may not be a metal, as long as its thermal conductivity is higher than that of air. This improves heat dissipation efficiency, as compared with dissipating heat from the driver IC 160 directly to outside air.

With respect to the sub scanning direction, a width of the upper face of the passage unit 140 is larger than a width of a lower face of the ink reservoir 130. The ink reservoir 130 is disposed at a center of the passage unit 140 with respect to the sub scanning direction. Therefore, the passage unit 140 has, at both end portions thereof with respect to the sub scanning direction, a region not in contact with the lower face of the ink reservoir 130. Recesses 141 are formed in this region. The recesses 141 are formed at positions corresponding to the respective projections 150*b* of the heat sink 150. In addition, the recess 141 has a size and a shape just-fittable with the projection 150*b* of the heat sink 150.

Figure 4A:
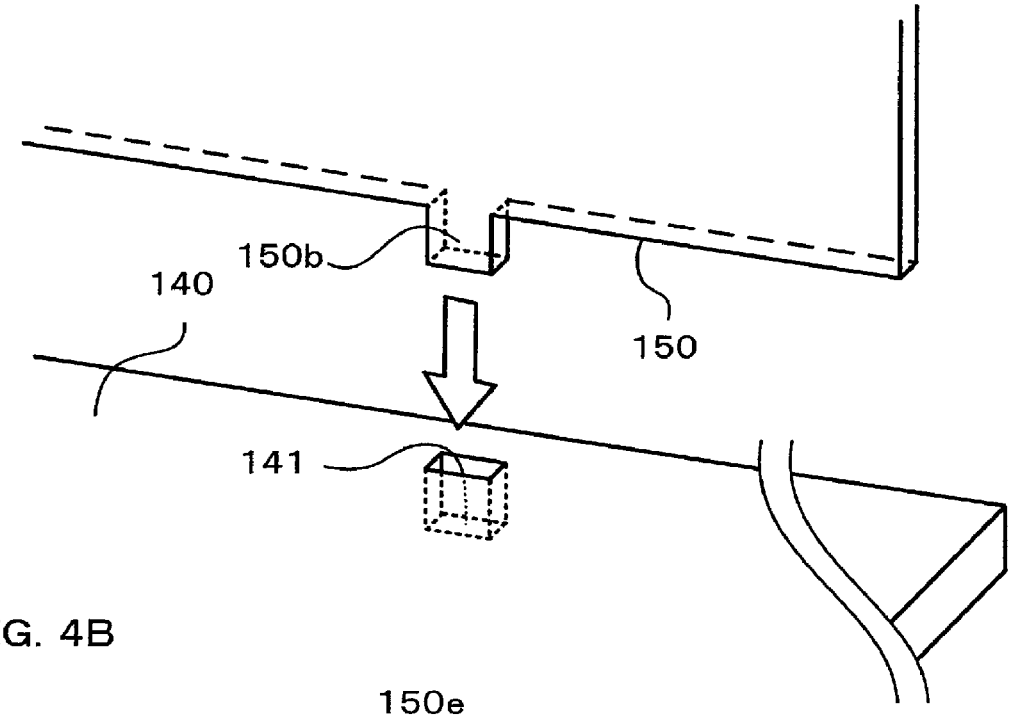
FIG. 4A schematically illustrates that the heat sink shown in FIG. 3B is being fixed to the ink-jet head.
Figure 4B:
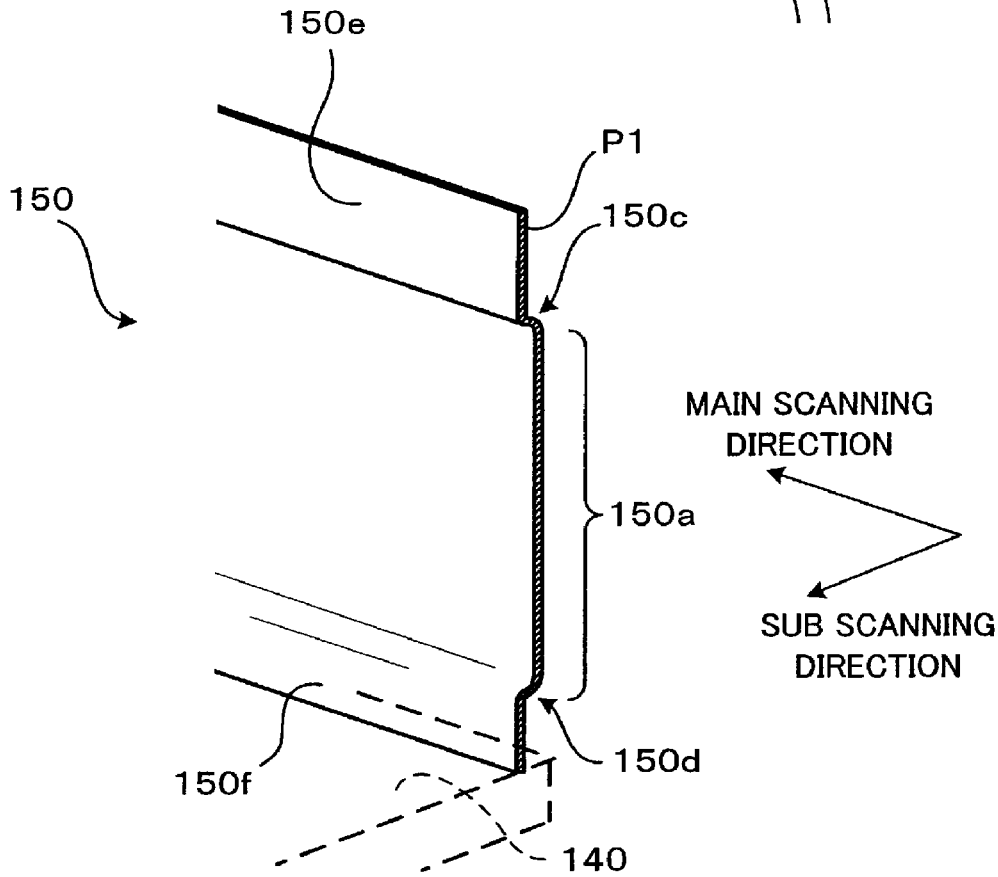
FIG. 4B is a perspective view showing a construction of the head sink shown in FIG. 3B, and partially including a vertical cross section.

FIGS. 4A and 4B are partial enlarged views of the heat sink 150 and the passage unit 140. FIG. 4A illustrates a state where the projection 150*b* of the heat sink 150 is fitted in the recess 141 of the passage unit 140. When the heat sink 150 is placed on the passage unit 140, the projections 150*b* of the heat sink 150 are fitted in the respective recesses 141 of the passage unit 140. By fitting of the projections 150*b* in the respective recesses 140, the heat sink 150 is placed on the upper face of the passage unit 140 so as to substantially perpendicularly stand thereon. As a result, even when external force is applied from outside of the passage unit 140 with respect to the sub scanning direction, displacement or deformation of the heat sink 150 can be restrained.

FIG. 4B is an enlarged view of a region of the heat sink 150 enclosed by alternate long and two short dashes lines L1 and L2 in FIG. 3B. FIG. 4B partially includes a cross section P1 of the heat sink 150. The cross section is sectioned along both the alternate long and two short dashes line L1 and the sub scanning direction in FIG. 3B. That is, the cross section is perpendicular to both a surface of the flat protrusion 150*a* and the upper face of the passage unit 140.

The heat sink 150 is made up of three portions, that is, a flat portion 150*e*, a flat portion 150*f*, and the flat protrusion 150*a*. The flat portion 150*e* extends from an upper end of the heat sink 150 to the flat protrusion 150*a*. The flat portion 150*f* extends from a lower end of the heat sink 150 to the flat protrusion 150*a*. The flat portions 150*e* and 150*f* (i.e., any one of first and second flat portions) extend along the same plane that is perpendicular to the sub scanning direction. The flat protrusion 150*a* (i.e., the other of first and second flat portions) locates outward of the flat portions 150*e* and 150*f*, with respect to the center of the passage unit 140 in the sub scanning direction. That is, in FIG. 4B, the flat protrusion 150*a* protrudes toward a right back direction. In this embodiment, an interval between respective end faces of the opposed flat protrusions 150*a* is substantially equal to a width of the passage unit 140 with respect to the sub scanning direction. As a result, in a case where a head unit having several ink-jet heads 100 arranged side by side is incorporated into an apparatus, unnecessary size increase can be suppressed and thus the head unit can be compactified.

The flat protrusion 150*a* is connected to the flat portions 150*e* and 150*f* via bent portions 150*c* and 150*d*, respectively. The bent portion 150*c* is bent at an upper end of the flat protrusion 150*a* toward the ink-reservoir 130 along the sub scanning direction, then further bent upward, and connected to a lower end of the flat portion 150*e*. The bent portion 150*d* is bent at a lower end of the flat protrusion 150*a* toward the ink-reservoir 130 along the sub scanning direction, then further bent downward, and connected to an upper end of the flat portion 150*f*. The flat protrusion 150*a* is formed by, for example, subjecting a metallic flat plate to press-working.

Figure 5:
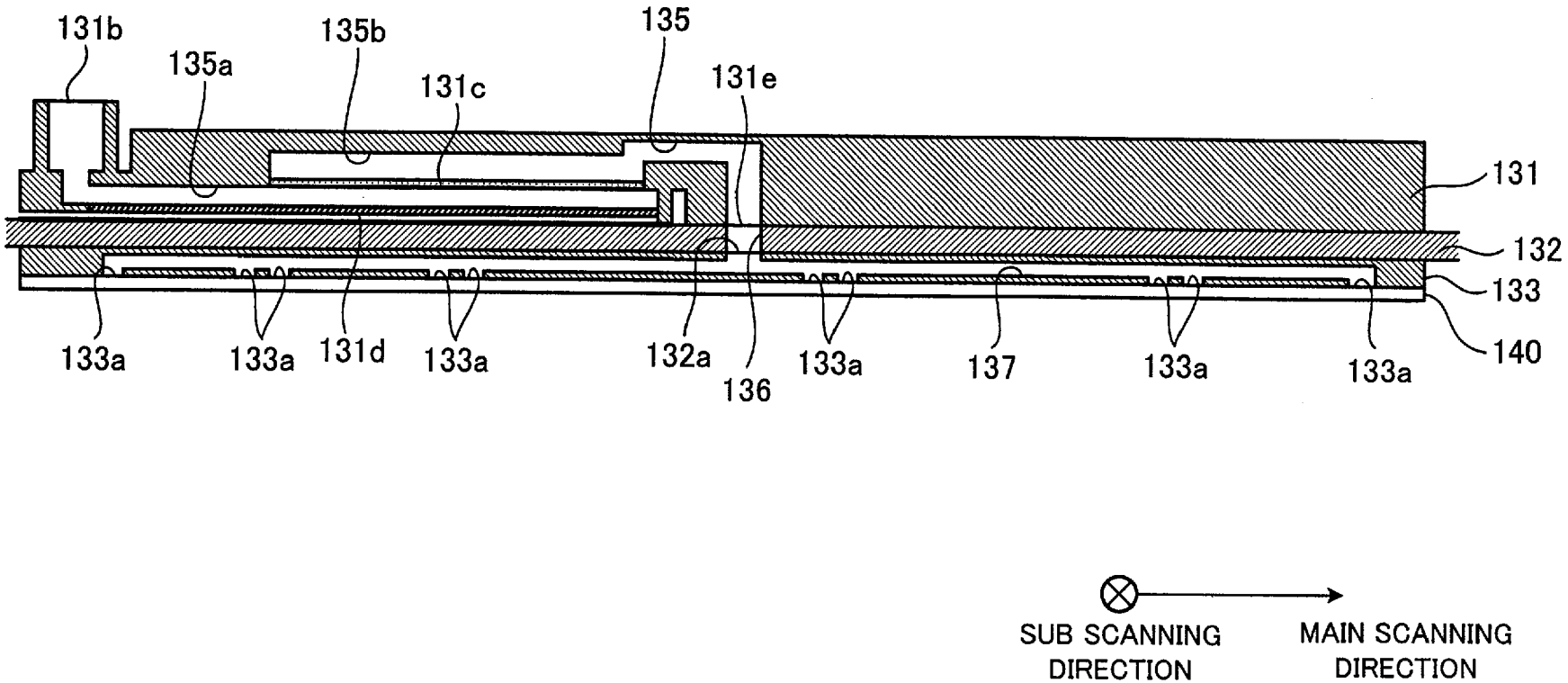
FIG. 5 shows a vertical cross section of an ink reservoir shown in FIG. 3A.

FIG. 5 shows a vertical cross section of the ink reservoir 130 as taken along both the main scanning direction and the up-and-down direction. An ink passage 135 is formed within the upper reservoir 131. An ink supply port 131*b* which is one opening of the ink passage 135 is formed on an upper face of the upper reservoir 131, and an ink passage port 131*e* which is the other opening of the ink passage 135 is formed on a lower face of the upper reservoir 131. The ink supply port 131*b* is formed at one end portion of the upper reservoir 131 with respect to the main scanning direction. The ink passage port 131*e* is formed at a central portion of the upper reservoir 131 with respect to both the main scanning direction and the sub scanning direction.

A path from one end to the other end of the ink passage 135 is as follows. The ink passage 135 firstly extends downward from the ink supply port 131*b*. Then, in the vicinity of the lower face of the upper reservoir 131, the ink passage 135 communicates with an extending region 135*a* that extends along the lower face of the upper reservoir 131. A flexible film member 131*d* is displaceably welded to the lower face of the upper reservoir 131. An upper face of the film member 131*d* constitutes a part of a bottom wall surface of the extending region 135*a*. The film member 131*d* freely displaces, thereby absorbing impact caused by a pressure wave that occurs in ink included in the ink passage 135.

The extending region 135*a* communicates with an extending region 135*b*. The extending region 135*b* is provided above the extending region 135*a*, and extends in parallel with a plane of extension of the extending region 135*a*. The extending region 135*a* and the extending region 135*b* are partitioned by a filter 131*c*, and communicate with each other through a mesh of the filter 131*c*.

The ink passage 135 extends from one end of the extending region 135*b* upward to the vicinity of the upper face of the upper reservoir 131. The one end of the extending region 135*b* is one of both ends thereof with respect to the main scanning direction, which is closer to a center of the upper reservoir 131. In the vicinity of the upper face of the upper reservoir 131, the ink passage 135 is bent toward the center of the upper reservoir 131 in the main scanning direction. Then, the ink passage 135 extends along the upper face of the upper reservoir 131 toward the center of the upper reservoir 131. When the ink passage 135 reaches the central portion of the upper reservoir 131, it is bent downward and extends toward the lower face of the upper reservoir 131. In the lower face of the upper reservoir 131, the ink passage 135 communicates with the ink passage port 131*e*.

An ink passage 136 is formed within the reservoir base 132. One opening of the ink passage 136 is formed on an upper face of the reservoir base 132, and communicates with the ink passage port 131*e*. An ink passage port 132*a* which is the other opening of the ink passage 136 is formed on a lower face of the reservoir base 132. The ink passage 136 extends downward from the ink passage port 131*e* to the ink passage port 132*a*.

An ink passage 137 is formed within the lower reservoir 133. One opening of the ink passage 137 is formed on an upper face of the lower reservoir 133. Several ink passage ports 133*a* which act as the other opening of the ink passage 137 are formed on a lower face of the lower reservoir 133. The ink passage ports 133*a* are opposed to the passage unit 140, and communicate with ink supply ports 140*a* formed on the upper face of the passage unit 140. A detailed description of the ink supply ports 140*a* will be given later.

The ink passage 137 is made up of the following three parts. A first part is a part extending along the main scanning direction along a central portion of the lower reservoir 133 with respect to the up-down-direction. A second part is a part extending from the first part upward to the ink passage port 132*a*. A third part is a part extending from the first part downward to the respective ink passage ports 133*a*. The second part is at a position overlapping the ink passage 136 in a plan view. The third part is at a position overlapping the respective ink passage ports 133*a* in a plan view.

Through the ink passages 135 to 137 thus formed in the ink reservoir 130, ink supplied from the ink supply port 131*b* flows into the passage unit 140. Before reaching the passage unit 140, ink passes through the filter 131*c* provided in the middle of the ink passage 135. At this time, the filter 131*c* filters out impurities contained in the ink.

Figure 6A:
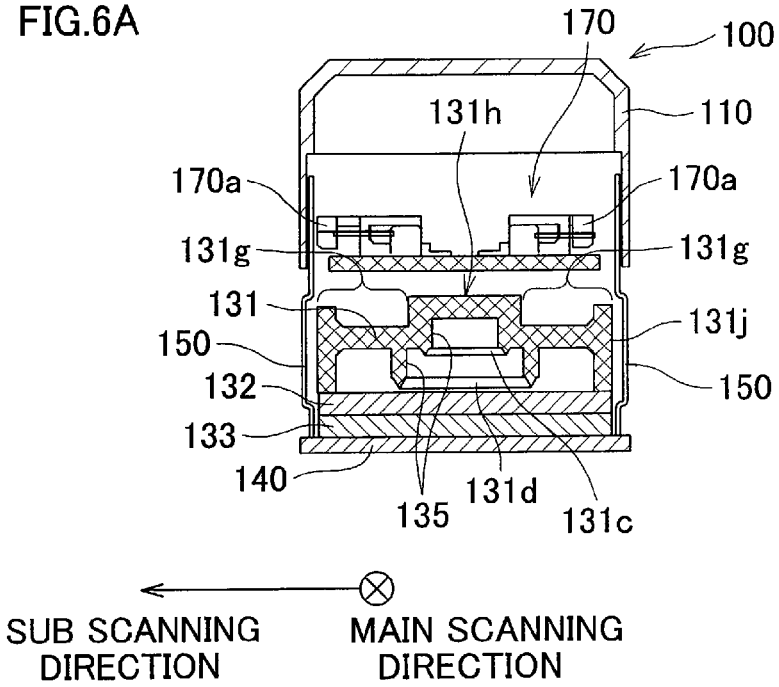
FIG. 6A shows a vertical cross section as taken along line Va-Va in FIG. 3A.
Figure 6B:
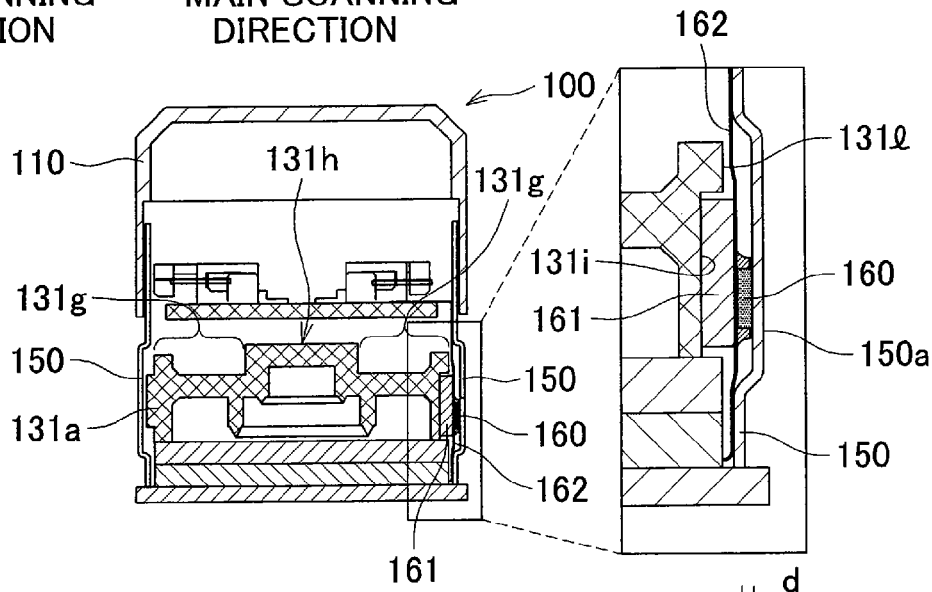
FIG. 6B shows a vertical cross section as taken along line Vb-Vb in FIG. 3A.
Figure 6C:
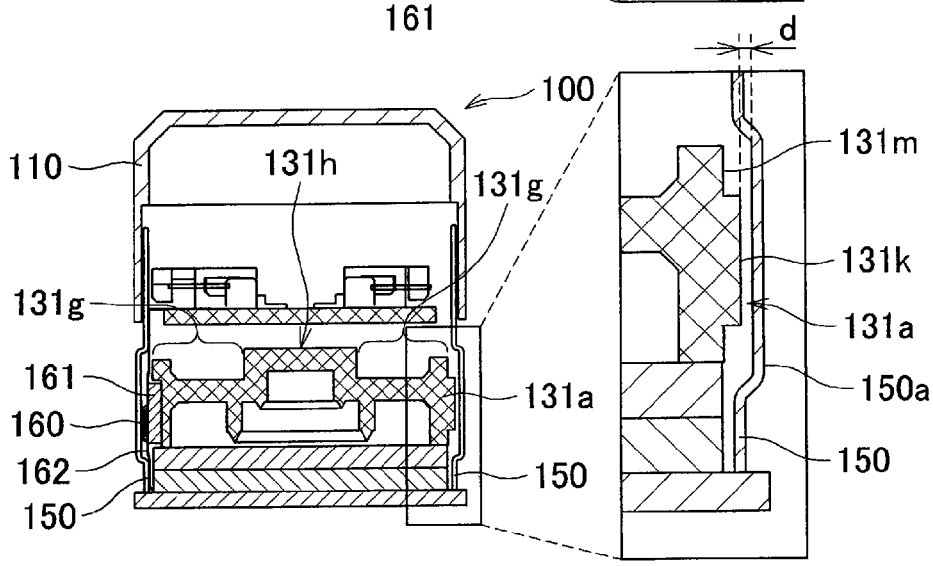
FIG. 6C shows a vertical cross section as taken along line Vc-Vc in FIG. 3A.

FIGS. 6A, 6B, and 6C show cross sections taken along lines Va-Va, Vb-Vb, and Vc-Vc in FIG. 3A, respectively. In FIGS. 6B and 6C, partial enlarged views of these cross sections are also shown. Since FIGS. 6A, 6B, and 6C illustrate the same parts, reference signs denoting the upper reservoir 131, the reservoir base 132, the lower reservoir 133, the control board 170, and the connector 170*a* are appropriately omitted in FIGS. 6A, 6B, and 6C. FIG. 6 shows sectional views in a state where the head covering 110, the heat sinks 150, the FPC 162, and the control board 170 are mounted.

Both side faces of the upper reservoir 131 with respect to the sub scanning direction include the following regions along the main scanning direction. For example, there is a region A in which neither driver IC 160 nor the restricting portion 131*a* is disposed on any of the side faces. Alternatively, there is a region B in which the restricting portion 131*a* is disposed on one side face while the driver IC 160 is disposed on the other side face. Alternatively, there is a region C in which both the restricting portion 131*a* and the driver IC 160 are disposed but side walls on which they are disposed are inverse to those in the region B.

FIGS. 6A to 6C illustrate cross sections sectioned in the above-mentioned regions A to C, respectively. As shown in FIGS. 6A to 6C, the upper reservoir 131 has an upper reservoir main body 131*h* and supporters 131*g*. The upper reservoir main body 131*h* constitutes a core of the upper reservoir 131 with respect to the sub scanning direction. The supporters 131*g* are provided on both sides of the upper reservoir main body 131*h* with respect to the sub scanning direction. The upper reservoir main body 131*h* has the ink passage 135 formed therein. The supporters 131*g* horizontally extend from the upper reservoir main body 131*h* toward both directions in the sub scanning direction. The supporter 131*g* protrudes upward and downward in its end portion closest to the heat sink. One of the protruding portions of the supporter 131*g* protruding downward is in contact with the reservoir base 132 so as to support a whole of the upper reservoir 131. At this time, a space appears between the upper face of the reservoir base 132 and the film member 131*d* welded to the lower face of the upper reservoir main body 131*h*, so that the film member 131*d* is freely displaceable in the up-and-down direction in accordance with a pressure wave of ink. The portion of the supporter 131*g* protruding upward serves as a rib that mechanically reinforces the upper reservoir 131.

In FIG. 5, a left half region of the upper reservoir 131 is made up of both the upper reservoir main body 131*h* and the supporters 131*g*. On the other hand, a right half region thereof does not include the upper reservoir main body, but it includes the supporters 131*g* extending toward both directions in the sub scanning direction. That is, the supporters 131*g* are formed over an entire region of the upper reservoir 131 with respect to the main scanning direction.

As mentioned above, FIG. 6A shows a cross section in the region where neither the driver IC 160 nor the restricting portion 131*a* is disposed. Each of the supporters 131g, which are disposed on both sides of the upper reservoir main body 131*h*, has an opposing face 131*j* opposed to the heat sink 150. The opposing face 131*j* extends along a plane perpendicular to the sub scanning direction, and its lower end is in contact with the reservoir base 132.

As mentioned above, FIG. 6B shows a cross section in the region where the driver IC 160 and the restricting portion 131*a* are disposed on the respective side faces of the upper reservoir 131. FIG. 6B contains a partial enlarged view showing a neighborhood of the driver IC 160. In FIG. 6B, the supporter 131*g* has an opposing face 131*l* and an opposing face 131*i* that are perpendicular to the sub scanning direction and opposed to the heat sink 150. The opposing face 131*l* is formed in an upper part of the supporter 131*g*. The opposing face 131*l* and the opposing face 131*j* are along the same plane that is perpendicular to the sub scanning direction. The opposing face 131*i* is formed in a lower part of the supporter 131*g*. With respect to the sub scanning direction, the opposing face 131*i* is more distant from the heat sink 150 than the opposing face 131*l* is. That is, there is a step between the opposing face 131*i* and the opposing face 131*l*. The lower end of the supporter 131*g* is in contact with the reservoir base 132, to support the upper reservoir 131.

The elastic member 161 is fixed to the opposing face 131*i*. The elastic member 161 is made of an elastic material deformable on receiving external force such as a sponge, and has a substantially rectangular parallelepiped shape. The driver IC 160 is placed between the elastic member 161 and the heat sink 150. Thus, the driver IC 160 is sandwiched between the supporter 131*g* and the heat sink 150 with interposition of the elastic member 161. As described above, the face of the driver IC 160 opposed to the heat sink 150 is in contact with the heat sink 150, so that heat generated by the driver IC 160 is dissipated through the heat sink.

The FPC 162 is sandwiched between the driver IC 160 and the elastic member 161. The FPC 162 extends in the up-and-down direction along the side face of the ink reservoir 130 (including the upper reservoir 131, the reservoir base 132, and the lower reservoir 133). One end of the FPC 162 is connected to the connector 170*a*, and the other end is inserted between the passage unit 140 and the lower reservoir 133.

A thickness of the elastic member 161 is set in such a manner that, when the elastic member 161 is fixed to the opposing face 131*i* , its surface facing the heat sink 150 is closer to the heat sink 150 than the opposing face 131*l* is. At this time, the thickness is adjusted so as to make the elastic member 161 always press and bias the driver IC 160 to the flat protrusion 150*a* with interposition of the FPC 162. In other words, an interval between the heat sink 150 and the opposing face 131*i* is adjusted to an extent of compression of the elastic member 161 in the sub scanning direction. As a result, the driver IC 160 can surely be in contact with the heat sink 150, and therefore heat in the driver IC 160 can surely be dissipated through the heat sink 150.

It may be possible that the driver IC 160 is adhered to the heat sink 150 with a thermosetting adhesive or the like. In this case, the thermosetting adhesive is preferably not applied to the contact face of the driver IC 160 with the heat sink 150. It is preferable that, for example, the adhesive is applied so as to span the heat sink 150 and a side face of the driver IC 160 that exists between the contact face of the driver IC 160 and a face thereof parallel to the contact face. This is because interposition of the thermosetting adhesive makes it difficult for heat in the driver IC 160 to transfer to the heat sink 150.

As mentioned above, FIG. 6C shows a cross section in the region where both the restricting portion 131*a* and the driver IC 160 are disposed but side walls on which they are disposed are inverse to those in the region B. FIG. 6C contains a partial enlarged view showing a neighborhood of the restricting portion 131*a*. The supporter 131*g* has an opposing face 131*k* and an opposing face 131*m* that are perpendicular to the sub scanning direction and opposed to the heat sink 150. The opposing face 131*m* is formed in an upper part of the supporter 131*g*. The opposing face 131*m* and the opposing face 131*j* are along the same plane that is perpendicular to the sub scanning direction. The opposing face 131*k* is formed in a lower part of the supporter 131*g*. With respect to the sub scanning direction, the opposing face 131*k* is closer to the heat sink 150 than the opposing face 131*m* is. That is, there is a step between the opposing face 131*k* and the opposing face 131*m*. Like in the above for the opposing face 131*i*, the lower end of the supporter 131*g* is in contact with the reservoir base 132, to support the upper reservoir 131.

The restricting portion 131*a* is formed integrally with the supporter 131*g*. The restricting portion 131*a* is a protrusion protruding to the opposing face 131*k* from a plane that is along the opposing face 131*m*. Here, a distance d between the opposing face 131*k* and the heat sink 150 is adjusted to a predetermined value. In the following, the restricting portion 131*a* and the distance d will be described in more detail.

When the ink-jet head 100 is gripped in order to be mounted on a printer, it is gripped by a hand across its shorter direction. At this time, external force F is applied to the heat sink 150 directly or through the head covering 110. The external force F is directed from outside to inside of the ink-jet head 100 with respect to the sub scanning direction.

Figure 7:
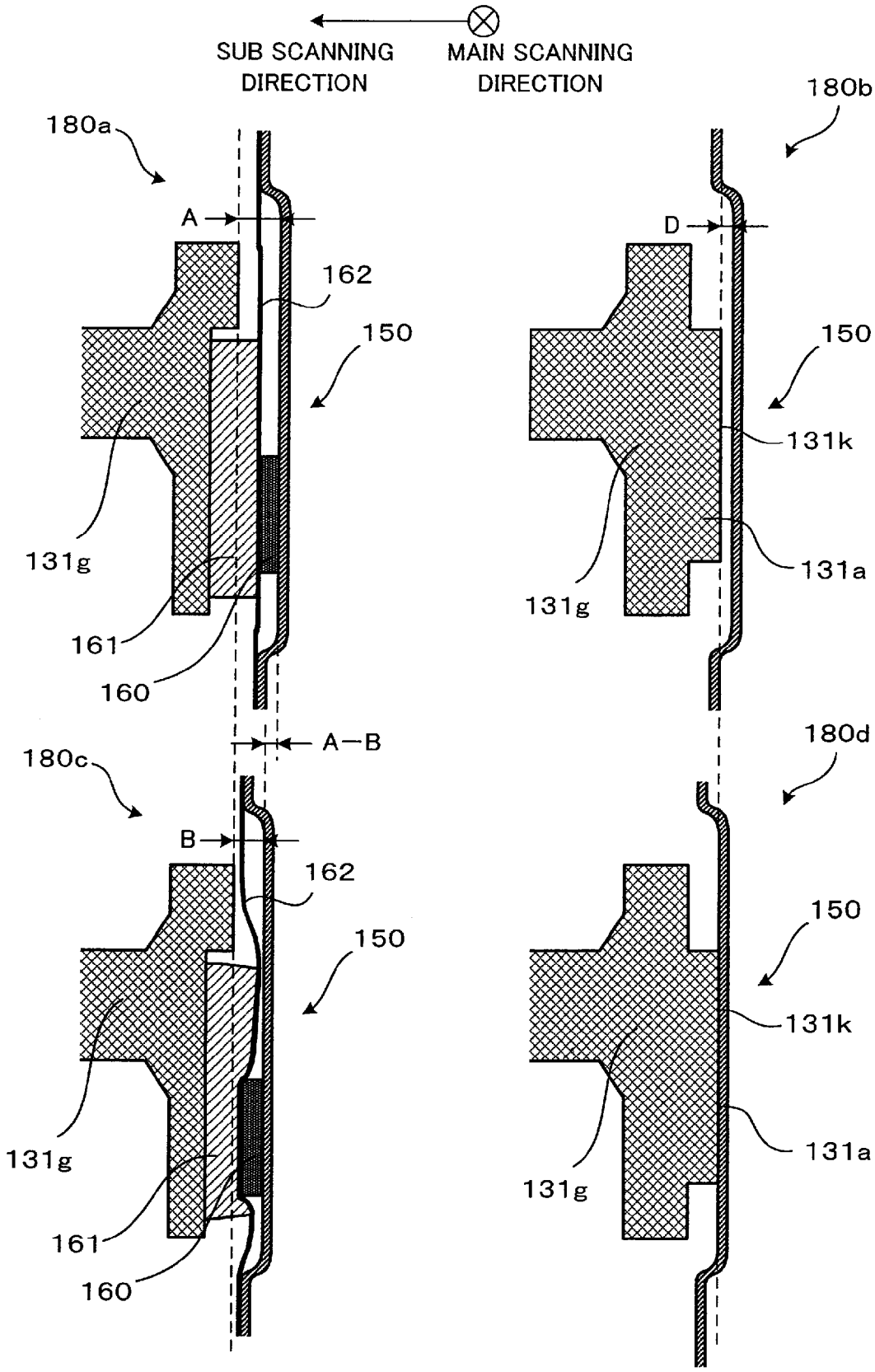
FIG. 7 is partial enlarged views of a supporter shown in FIG. 6.

Enlarged views 180*a* to 180*d* of FIG. 7 are enlarged views of the cross sections shown in FIG. 6, and illustrate neighborhoods of the driver IC 160 and the restricting portions 131*a*. In the enlarged views 180*a* and 180*b*, external force F is not applied to the heat sink 150. In the enlarged views 180*c* and 180*d*, external force F is applied to the heat sink 150. The enlarged views 180*a* and 180*c* show a cross section of a first location in which the supporter 131*g* and the heat sink 150 sandwich the driver IC 160 therebetween with interposition of the elastic member 161. The enlarged views 180*b* and 180*d* show a cross section of a second location in which the driver IC 160 is not sandwiched.

When external force F moves a whole of the heat sink 150 to inside of the ink-jet head 100 in the sub scanning direction, the driver IC 160 is further pressed to the elastic member 161. In the following, unless noted otherwise, a bending amount of the heat sink 150 itself is small enough to be disregarded, as compared with an amount of movement of the whole of the heat sink 150 in the sub scanning direction.

When the driver IC 160 is pressed to the elastic member 161, the elastic member 161 is further more compressed than when no external force F is applied thereto. Even when the external force F changes, such compressive deformation of the elastic member 161 makes the change gentle, and therefore change in force that is applied to the driver IC 160 is made gentle, too. In addition, pressure applied to the driver IC 160 is dispersed. This can prevent the driver IC 160 from receiving excessive load.

However, when the external force F becomes larger to compress the elastic member 161 to the maximum limit so that the elastic member 161 is no longer compressible, the elastic member 161 can no longer absorb change in the external force F and dissipate pressure. In such a case, consequently, excessive load is put on the driver IC 160 which may therefore be damaged.

The restricting portion 131*a* serves to prevent the driver IC 160 from receiving excessive load. As mentioned above, the restricting portion 131*a* is formed in the second location in which the supporter 131*g* and the heat sink 150 do not sandwich the driver IC 160, as shown in the enlarged views 180*b* and 180*d*. Since the opposing face 131*k* formed on the restricting portion 131*a* comes into contact with the heat sink 150 as shown in the enlarged view 180*d*, movement of heat sink 150 is restricted so as to prevent a distance between the heat sink 150 and the supporter 131*g* from becoming equal to or smaller than a distance therebetween in the first location (as shown in the enlarged views 180*a* and 180*c*). Here, the distance means the smallest one of distances between the supporter 131*g* and the heat sink 150 with respect to the sub scanning direction.

In the state shown in the enlarged view 180*b* where the external force F is not applied, a distance D between the supporter 131*g* and the heat sink 150 is adjusted as follows. Here, it is assumed that the enlarged view 180*c* shows the elastic member 161 being compressed to the maximum limit. Also, it is assumed that a distance (a minimum distance) between the supporter 131*g* and the heat sink 150 in the state shown in the enlarged view 180*c* is B while a distance between the supporter 131*g* and the heat sink 150 in the state shown in the enlarged view 180*a*, that is, in the state where no external force F is applied, is A. The distance D is adjusted to smaller than A-B.

Like this, the distance D is adjusted to smaller than A-B. Accordingly, even when the external force F is applied to the heat sink 150, a distance between the supporter 131*g* and the heat sink 150 does not become equal to or smaller than B, in the location where the driver IC 160 is sandwiched. That is, even though the heat sink 150 is moved by application of the external force F, the heat sink 150 comes into contact with the restricting portion 131*a* before the elastic member 161 is compressed to the maximum limit. Therefore, even though the external force F further increases, force applied by the heat sink 150 is dispersed as force applied to the opposing face 131*k*. This can prevent the driver IC 160 from receiving excessive load.

In a case where a material or a shape of the heat sink 150 are easy to bend, application of the external force F may cause the heat sink 150 in the first location to get closer to the supporter 131*g* beyond the distance D even while the heat sink 150 in the second location is in contact with the supporter 131*g* after being moved by the distance D. When the heat sink 150 is bent, the heat sink 150 in the first location not only as a whole moves and gets closer to the supporter 131*g*, but also may largely approach the supporter 131*g* as a result of bending. Since the heat sink 150 is elongated in the main scanning direction, the heat sink 150 is bent into protrusion more often in a plan view than in a cross section perpendicular to the sub scanning direction.

However, the heat sink 150 of this embodiment has the bent portions 150*c* and 150*d*. Each of the bent portions 150*c* and 150*d* extends along the main scanning direction. This makes it difficult for the heat sink 150 to be bent into protrusion in a plan view. Therefore, while the heat sink 150 in the second location is moved by the distance d due to application of the external force F, the heat sink 150 in the first location does not easily get closer to the supporter 131*g* beyond the distance D. Thus, the driver IC 160 can more surely be prevented from receiving excessive load.

In addition, as shown in FIGS. 3A, 3B, and 4A, in order to fix the heat sink 150 to the passage unit 140, the projections 150*b* of the heat sink 150 are fitted in the recesses 141 of the passage unit 140. Therefore, the heat sink 150 can surely be fixed to the passage unit 140, and at the same time bending of the heat sink 150 can be prevented more surely.

In this embodiment, as shown in FIGS. 2 and 3A, the driver ICs 160 and the restricting portions 131*a* are disposed on the side faces of the ink reservoir 130 so as to be opposed to each other with respect to the sub scanning direction and so as to alternate with each other along the main scanning direction. That is, the restricting portions 131*a* and the driver ICs 160 are distributed uniformly, as compared with when the restricting portions 131*a* concentrate only in a certain region with respect to the main scanning direction. Two of the four driver ICs 160 are sandwiched between two restricting portions 131*a* with respect to the main scanning direction. Therefore, when the external force F is applied to the heat sink 150, force given from the heat sink 150 is more uniformly dispersed to the restricting portions 131*a*. Consequently, the driver IC 160 can more surely be prevented from receiving excessive load.

Figure 8A:
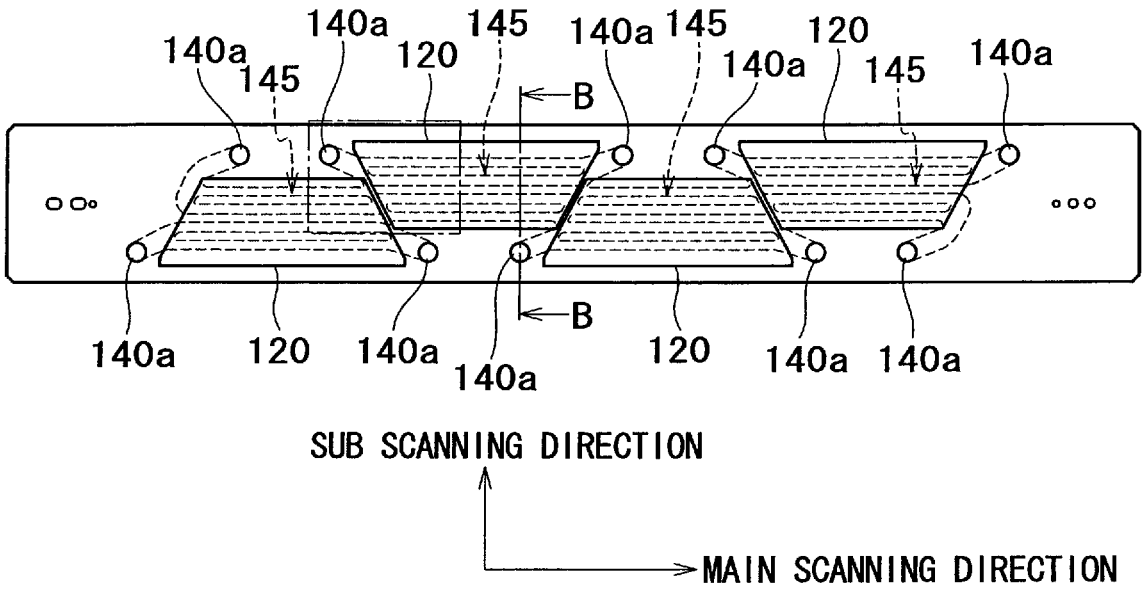
FIG. 8A is a plan view of a passage unit shown in FIGS. 2 to 6.

In the following, a description will be given to the passage unit 140 and the actuator unit 120. FIG. 8A is a top plan view of the passage unit 140. The actuator unit 120 is bonded to an upper face of the passage unit 140. The actuator unit 120 having a trapezoidal shape is disposed with its parallel opposed sides extending in parallel with the main scanning direction. A total of four actuator units 120 are, as a whole, arranged in a zigzag pattern on the passage unit 140. Two of the four actuator units 120 are arranged along one of two imaginary lines extending in the main scanning direction, and the other two of the four actuator units 120 are arranged along the other of the two imaginary lines. Oblique sides of every neighboring actuator units 120 on the passage unit 140 partially overlap each other with respect to the sub scanning direction.

Manifold channels 5, which are a part of ink passages, are formed within the passage unit 140. Several ink supply ports 140*a* are formed on the upper face of the passage unit 140. Each manifold channel 5 has its one end communicating with each of the ink supply ports 140*a*. There are a total of ten ink supply ports 140*a* arranged five by five along two lines extending in parallel with a longitudinal direction of the passage unit 140. The ink supply ports 140*a* are provided at positions away from where the four actuator units 120 are disposed.

Figure 8B:
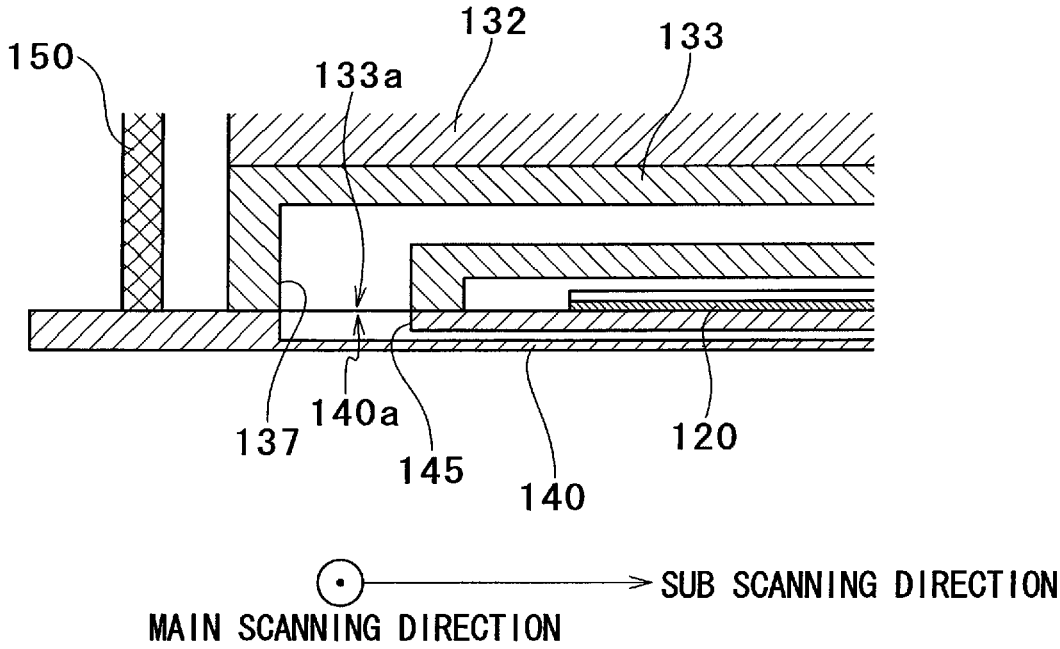
FIG. 8B shows a vertical cross section including the ink reservoir, as taken along line B-B in FIG. 8A.

FIG. 8B shows a cross section taken along line B-B in FIG. 8A. The cross section shown in FIG. 8B illustrates not only the passage unit 140 and the actuator unit 120 but also the ink reservoir 130 and the heat sink 150. As shown in FIG. 8B, the ink supply ports 140*a* communicate with the ink passage ports 133*a* formed in the lower reservoir 133. Through the ink supply ports 140*a*, ink is supplied from the ink reservoir 130 into the manifold channels 5.

As shown in FIG. 8B, the lower reservoir 133 and the passage unit 140 are spaced apart from each other except for where the ink supply ports 140*a* communicate with the ink passage ports 133*a*. The actuator units 120 are disposed in a space between the lower reservoir 133 and the passage unit 140, and opposed to a lower face of the lower reservoir 133. An FPC 162 is connected to an upper face of each actuator unit 120.

Figure 9:
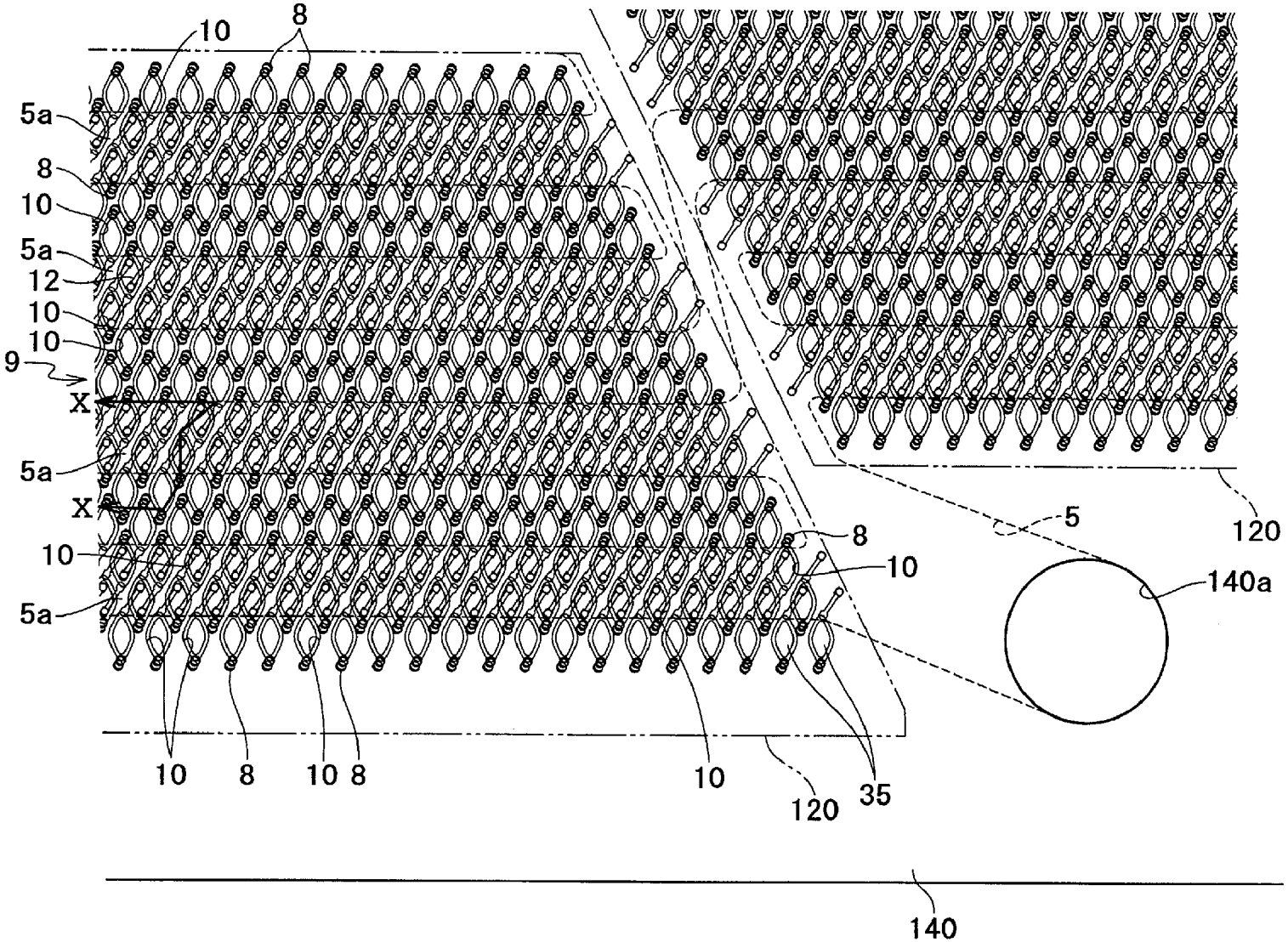
FIG. 9 is an enlarged view of a region enclosed by an alternate long and short dash line in FIG. 8A.

FIG. 9 is a top plan view showing on an enlarged scale a region enclosed by an alternate long and short dash line in FIG. 8A. In FIG. 9, for the purpose of explanatory convenience, the actuator units 120 are illustrated with alternate long and two short dashes lines, while apertures 12, nozzles 8, and the like which are formed within the passage unit 140 or on a lower face of the passage unit 140 and therefore should actually be illustrated with broken lines are illustrated with solid lines.

Several sub manifold channels 5*a* are branched from each manifold channel 5 formed within the passage unit 140. The sub manifold channels 5*a* neighbor each other and extend in regions within the passage unit 140 opposed to the respective actuator units 120. As shown in FIG. 9, the two actuator units 120 neighboring each other share one manifold channel 5 from both side of which four sub manifold channels 5*a* are branched.

The passage unit 140 has pressure chamber groups 9 in each of which pressure chambers 10 are formed in a matrix. Each pressure chamber 10 is a hollow region having, in a plan view, a substantially rhombic shape with its corners rounded. The pressure chambers 10 are formed so as to open on the upper face of the passage unit 140. The pressure chambers 10 are arranged on the upper face of the passage unit 140, substantially throughout an entire region opposed to each actuator unit 120. Therefore, an area occupied by each pressure chamber group 9 made up of the pressure chambers 10 has substantially the same size and the same shape as those of the actuator unit 120. The actuator units 120 are bonded to the upper face of the passage unit 140, thereby closing openings of the respective pressure chambers 10.

In this embodiment, the pressure chambers 10 are arranged side by side at regular intervals along the main scanning direction, and thus sixteen pressure chamber rows are formed as a whole. The number of pressure chambers 10 included in each pressure chamber row is in conformity with a contour of the pressure chamber group 9. The number of pressure chambers 10 included in each pressure chamber row is reduced gradually from the pressure chamber row corresponding to a longer side of the actuator unit 120 to the pressure chamber row corresponding to a shorter side thereof.

On the upper face of the actuator unit 120, an individual electrode 35 which will be described later is formed at a position opposed to each pressure chamber 10. A shape of the individual electrode 35 is substantially similar to but a little smaller than that of the pressure chamber 10. The individual electrode 35 is disposed on the upper face of the actuator unit 120 so as to fall within a region opposed to the pressure chamber 10.

The passage unit 140 has many nozzles 8. The nozzles 8 are provided on a lower face of the passage unit 140, at positions away from regions opposed to the sub manifold channels 5*a*. In addition, the nozzles 8 are provided on the lower face of the passage unit 140, in regions opposed to the actuator units 120. In each of the regions, the nozzles 8 are arranged at regular intervals along several lines extending in parallel with the longitudinal direction of the passage unit 140.

The nozzles 8 are positioned in such a manner that their projective points on an imaginary line extending in parallel with the longitudinal direction of the passage unit 140 can be consecutively arranged at regular intervals corresponding to a print resolution, when all of them are projected onto the imaginary line in a direction perpendicular to the imaginary line. As a result, the ink-jet head 100 is able to perform a consecutive printing at intervals corresponding to the print resolution, substantially throughout a longitudinal region of the passage unit 140 where the nozzles 8 are formed.

Many apertures 12 are formed within the passage unit 140. The apertures 12 are disposed in a region opposed to each pressure chamber group 9. In this embodiment, the aperture 12 extends in one direction parallel to a horizontal plane.

Formed within the passage unit 140 are communication holes that make communication among the respective apertures 12, the respective pressure chambers 10, and the respective nozzles 8. The communication holes communicate with one another, to form individual ink passages 32 (see FIG. 10). Each individual ink passage 32 communicates with a sub manifold channel 5*a*. Ink supplied to the manifold channel 5 is then supplied through the sub manifold channels 5*a* to the respective individual ink passages 32, and then ejected from the nozzles 8.

Figure 10:
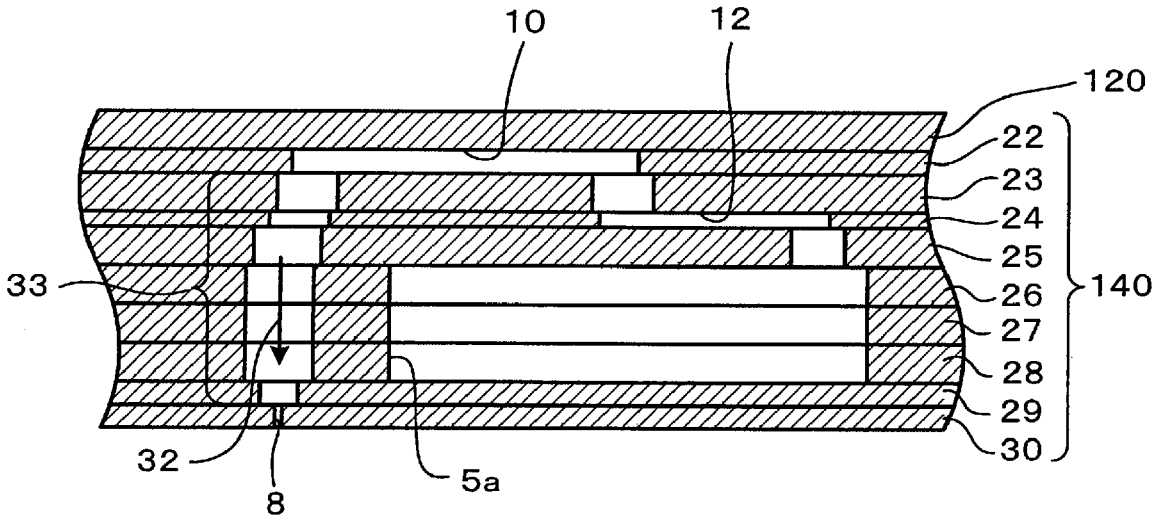
FIG. 10 shows a vertical cross section as taken along line X-X in FIG. 9.

A cross-sectional structure of the passage unit 140 and the actuator unit 120 will be described. FIG. 10 shows a vertical cross section as taken along line X-X in FIG. 9. FIG. 10 illustrates a cross-sectional structure of a unit element that ejects ink from a nozzle 8. The unit element includes one individual ink passage 32 that is formed within the passage unit 140, and one ejection actuator that is defined by a later-described individual electrode 35.

The passage unit 140 has a layered structure laminated with plates. The plates are, from the upper face of the passage unit 140, a cavity plate 22, a base plate 23, an aperture plate 24, a supply plate 25, manifold plates 26, 27, 28, a cover plate 29, and a nozzle plate 30. Many communication holes are formed in these plates. The plate are positioned and laminated with each other in such a manner that the communication holes communicate with each other so as to form individual ink passages 32 and sub manifold channels 5*a*. As shown in FIG. 10, the pressure chamber 10 is disposed on the upper face of the passage unit 140, the sub manifold channel 5*a* is disposed in an inside middle portion of the passage unit 140, and the nozzle 8 is disposed on the lower face of the passage unit 140. In this way, respective constituents of the individual ink passage 32 are disposed adjacent to each other at different positions, and the communication holes make communication between the sub manifold channel 5*a* and the nozzle 8 through the pressure chamber 10.

The communication holes formed in the respective plates will be described. These communication holes include the following ones. First, there is mentioned a pressure chamber 10 that is formed in the cavity plate 22. Second, there are mentioned communication holes A that form a passage extending from one end of the pressure chamber 10 to a sub manifold channel 5*a*. The communication holes A are formed in the respective plates including the base plate 23 (as an entrance to the pressure chamber 10) to the supply plate 25 (as an exit from the sub manifold channel 5*a*). The communication holes A include an aperture 12 formed in the aperture plate 24.

Third, there are mentioned communication holes B that form a passage extending from the other end of the pressure chamber 10 to a nozzle 8. The communication holes B are formed in the respective plates including the base plate 23 (as an exit from the pressure chamber 10) to the cover plate 29. Fourth, there is mentioned the nozzle 8 formed in the nozzle plate 30. Fifth, there are mentioned communication holes C that constitute the sub manifold channel 5*a*. The communication holes C are formed in the manifold plates 26 to 28.

These communication holes communicate with each other, and thus form an individual ink passage 32 extending from an inflow port for ink contained in the sub manifold channel 5*a*, that is, from the exist from the sub manifold channel 5*a*, to the nozzle 8. Ink supplied into the sub manifold channel 5*a* flows out to the nozzle 8 through a path described below. The ink first extends upward from the sub manifold channel 5*a*, to one end portion of the aperture 12. Then, the ink goes horizontally along an extending direction of the aperture 12, to the other end portion of the aperture 12, from which the ink then extends upward to one end portion of the pressure chamber 10. Then, the ink goes horizontally along an extending direction of the pressure chamber 10, to the other end portion of the pressure chamber 10, from which the ink then extends obliquely downward through three plates, and goes vertically downward to the nozzle 8.

Figure 11:
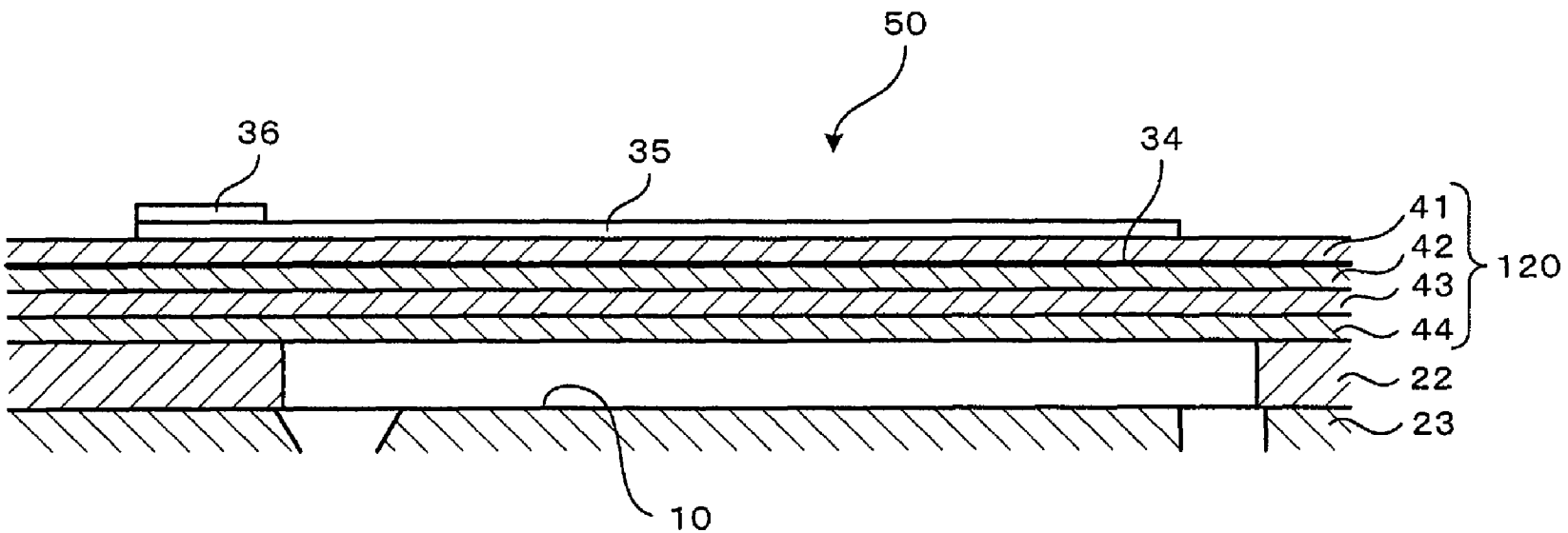
FIG. 11 is an enlarged view of a vicinity of a piezoelectric actuator shown in FIG. 10.

As shown in FIG. 11, the actuator unit 120 has a layered structure made up of piezoelectric layers 41, 42, 43 and 44. Each of the piezoelectric layers 41 to 44 has a thickness of approximately 15 μm. The actuator unit 120 as a whole has a thickness of approximately 60 μm. Any of the piezoelectric layers 41 to 44 extends over pressure chambers 10 (see FIG. 9). The piezoelectric layers 41 to 44 are made of a lead zirconate titanate (PZT)-base ceramic material having ferroelectricity.

The actuator unit 120 has individual electrodes 35 and a common electrode 34 that are made of a metal material such as Ag—Pd-base one. As described above, the individual electrodes 35 are disposed on the upper face of the actuator unit 120, at positions opposed to the respective pressure chambers 10. One end of the individual electrode 35 extends out beyond a region opposed to the pressure chamber 10, and provided with a land 36. The land 36 is made for example of gold including glass frits, has a thickness of approximately 15 μm, and has a protruding shape. The land 36 is electrically bonded to a not-shown contact that is formed in the FPC 162.

In a case where the ink-jet head 100 is installed in a printer for example, a controller built on the control board is electrically connected to a main controller of the printer. In accordance with a command from the main controller of the printer, the controller built on the control board 170 commands the driver IC 160 to supply a voltage pulse corresponding to ink ejection. In accordance with the command, the driver IC 160 supplies a voltage pulse through the FPC 162 to an individual electrode 35. The voltage pulse acts as a drive signal corresponding to ink ejection.

The common electrode 34 is interposed between the piezoelectric layer 41 and the piezoelectric layer 42, substantially throughout an entire face in a plane direction. That is, the common electrode 34 extends over all of pressure chambers 10 that exist in the region opposed to the actuator unit 120. The common electrode 34 has a thickness of approximately 2 μm. The common electrode 34 is grounded in a not-shown region, and held at the ground potential.

As shown in FIG. 11, the two electrodes are disposed so as to sandwich only the uppermost piezoelectric layer 41 therebetween. A region of the piezoelectric layer 41 sandwiched between each individual electrode 35 and the common electrode 34 is referred to as an active portion. In the actuator unit 120 of this embodiment, only the uppermost piezoelectric layer 41 includes active portions, and the other piezoelectric layers 42 to 44 include no active portion. That is, the actuator unit 120 has a so-called unimorph type structure.

When a predetermined voltage pulse is selectively supplied to an individual electrode 35, pressure is applied to ink contained in a pressure chamber 10 that corresponds to this individual electrode 35. As a result, through an individual ink passage 32, ink is ejected from a corresponding nozzle 8. More specifically, portions of the actuator unit 120 opposed to the respective pressure chambers 10 serve as individual piezoelectric actuators 50 (i.e., ejection actuators) each corresponding to each pressure chamber 10 and each nozzle 8. Like this, piezoelectric actuators 50, the number of which is equal to the number of the individual electrodes 35, are provided in the actuator unit 120. In this embodiment, upon one ejection operation, approximately 3 to 4 pl (pico liter) of ink is ejected from a nozzle 8.

In the following, other embodiments presenting alternatives of the restricting portion 131*a* of the above-described embodiment will be described. FIGS. 12A to 12D show such other embodiments. FIGS. 12A to 12D illustrate a heat sink and a supporter in a state where external force F is not applied to the heat sinks.

FIG. 12A shows a neighborhood of a supporter 231*g* in a second location. The supporter 231*g* has a restricting portion 231*a* whose shape is different from that of the restricting portion 131*a*. Except for a portion shown in FIG. 12, an ink-jet head according to the embodiment shown in FIG. 12A has the same construction as that of the above-described embodiment. The same is applicable to other embodiments which will be described later.

The supporter 231*g* has an opposing face 231*m* and an opposing face 231*k* that are perpendicular to the sub scanning direction and opposed to the heat sink 150. With respect to the sub scanning direction, a position of the opposing face 231*m* is the same as a position of the opposing face 131*j* (see FIG. 6A). With respect to the sub scanning direction, the opposing face 231*k* is closer to the heat sink 150 than the opposing face 231*m* is. The restricting portion 231*a* is formed integrally with the supporter 231*g*. The restricting portion 231*a* is a protrusion protruding to the opposing face 231*k* from a plane that is along the opposing face 231*m*. In this case, the opposing face 231*k* may be in contact with the heat sink 150.

In FIG. 12B, a restricting portion is formed on a heat sink in the second location. A heat sink 250 shown in FIG. 12B has the same construction as that of the heat sink 150, except that the heat sink 250 includes a restricting portion 250*g*. The heat sink 250 has a flat protrusion 250*a*. The flat protrusion 250*a* extends along a plane perpendicular to the sub scanning direction. As compared with portions of the heat sink 250 other than the flat protrusion 250*a*, the flat protrusion 250*a* protrudes outward of the ink-jet head 100 with respect to the sub scanning direction. A surface of the flat protrusion 250*a* opposed to a supporter 331*g* includes an opposing face 250*m* and an opposing face 250*k* that are perpendicular to the sub scanning direction. With respect to the sub scanning direction, the opposing face 250*k* is closer to the supporter 331*g* than the opposing face 250*m* is. The restricting portion 250*g* is a protrusion protruding to the opposing face 250*k* from a plane that is along the opposing face 250*m*. The restricting portion 250*g* may be formed integrally with the heat sink 250, or alternatively another member having good thermal conductivity may be fixed to the restricting portion 250*g*.

On the other hand, a cross section of the supporter 331*g* shown in FIG. 12B is the same as that of the supporter 131*g* shown in FIG. 6A. That is, the supporter 331*g* has no protrusion acting as a restricting portion.

A distance d1 between the heat sink 250 and the supporter 331*g* is adjusted to smaller than a-b, where b is a distance (a minimum distance) between the supporter 131*g* and the heat sink 150 in the state shown in the enlarged view 180*c* of FIG. 7 while a is a distance between the supporter 131*g* and the heat sink 150 in the state shown in the enlarged view 180*a*, that is, in the state where no external force F is applied.

In FIG. 12C, a protrusion protruding in the sub scanning direction is not formed on any of a supporter and a heat sink in the second location. A supporter 431*g* shown in FIG. 12C has an opposing face 431*m* that is opposed to the heat sink 150. With respect to the sub scanning direction, a position of the opposing face 431*m* is the same as a position of the opposing face 131*j* shown in FIG. 6A. Except for the supporter 431*g*, a construction shown in FIG. 12C is the same as the construction shown in FIGS. 1 to 11. That is, in FIG. 12C, a protrusion protruding in the sub scanning direction is not formed on any of the supporter 431*g* and the heat sink 150.

However, an upper end of the supporter 431*g* locates higher than an upper end of the supporter 131*g* shown in FIG. 6A does. Moreover, the upper end of the supporter 431*g* locates higher than the bent portion 150*c* of the heat sink 150. That is, an upper end portion of the supporter 431*g* restricts the heat sink 150 from moving inward of the ink-jet head 100 with respect to the sub scanning direction beyond a certain degree.

Here, a distance d2 between the heat sink 150 and the supporter 431*g* is adjusted to smaller than a-b, where b is a distance (a minimum distance) between the supporter 131*g* and the heat sink 150 in the state shown in the enlarged view 180*c* of FIG. 7 while a is a distance between the supporter 131*g* and the heat sink 150 in the state shown in the enlarged view 180*a*, that is, in the state where no external force F is applied.

A cross section of a supporter 531*g* and the heat sink 150 shown in FIG. 12D is substantially the same as that of the supporter 131*g* and the heat sink 150 shown in FIG. 6A. The supporter 531*g* has an opposing face 531*m* that is opposed to the heat sink. With respect to the sub scanning direction, a position of the opposing face 531*m* is the same as a position of the opposing face 131*j* shown in FIG. 6A. In the embodiment shown in FIG. 12D, however, a restricting member 550, which is a member separated from both the heat sink 150 and the supporter 531*g*, is provided. The restricting member 550 has a substantially rectangular parallelepiped shape for example, and is fixed onto the opposing face 531*m*. The restricting member 550 restricts the heat sink 150 from moving inward of the ink-jet head 100 with respect to the sub scanning direction beyond a certain degree.

Here, a distance d3 between the heat sink 150 and the supporter 531*g* is adjusted to smaller than a-b, where b is a distance (a minimum distance) between the supporter 131*g* and the heat sink 150 in the state shown in the enlarged view 180*c* while a is a distance between the supporter 131*g* and the heat sink 150 in the state shown in the enlarged view 180*a*, that is, in the state where no external force F is applied.

The above-described embodiments present the following effects. The opposing face 231*k* of the restricting portion 231*a* shown in FIG. 12A is in contact with the heat sink 150, even when external force F is not applied to the heat sink 150. The heat sink 150 is thereby restricted from moving anymore inward of the ink-jet head 100 with respect to the sub scanning direction. Accordingly, in the first location (see FIG. 6B), the heat sink 150 is prevented from approaching the supporter 131*g* anymore, so that the driver IC 160 can be prevented from receiving excessive load.

In the embodiments shown in FIGS. 12B to 12D, the distances d1 to d3 between the supporter and the heat sink in the second location are adjusted in the above-described manner. Therefore, movement of the heat sink 151 is restricted before the elastic member 161 is compressed to the maximum limit in the first location. This can prevent the driver IC 160 from receiving excessive load.

Some preferred embodiments of the present invention have been described above. However, the present invention is not limited to the above-described embodiments. Various changes may be made within a scope of this invention.

For example, although in the above-described embodiment the driver IC 160 is supported on the supporter 131*g* which is a part of the ink reservoir 131, it may also be possible that another support member other than the ink reservoir 131 is provided to support the driver IC 160 thereon.

In addition, although in the above-described embodiment a bending amount of the heat sink 150 is assumed to be small, the present invention is also applicable when the bending amount is too large to be disregardable. In such a case, the supporter 131*g* and the heat sink 150 get closer to each other in the second location because of not only movement but also bending of the heat sink 150. Even though the heat sink 150 is bent and thereby gets closer to the supporter 131*g*, it suffices to dispose a restricting member in such a manner that it prevents the heat sink 150 from approaching the supporter 131*g* beyond a certain degree. More specifically, it suffices that both bending and movement of the heat sink 150 are restricted in the second location so as to prevent the elastic member 161 from being compressed to the maximum limit in the first location.

Figure 13A:
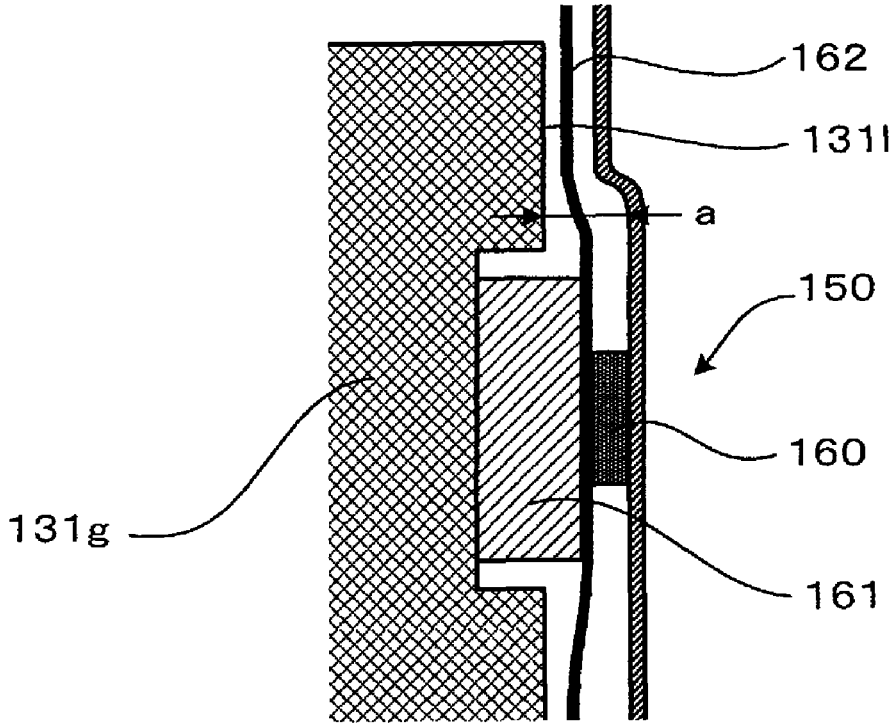
FIGS. 13A and 13B show a heat sink and a supporter according to still another embodiment different from the embodiment shown in FIG. 12.

In the respective embodiments described above, the first location may be so constructed that the side face of the supporter 131*g* is made up of the opposing face 131*l* that protrudes outward in the sub scanning direction, and the opposing face 131*i* that locates inner than the opposing face 131*l* in the sub scanning direction and is opposed to the flat protrusion 150*a* of the heat sink 150, and at the same time that a side end portion of the supporter 131*g* including, among the two opposing faces 131*i* and 131*l*, the opposing face 131*l* protrudes upward to such a position that the opposing face 131*l* and the upper flat portion 150*e* that is continuous with the flat protrusion 150*a* are opposed to each other. More specifically, among the two opposing faces 131*i* and 131*l* that constitute the side face of the supporter 131*g*, the opposing face 131*l* which is closer to the heat sink 150 may extend to a position opposed to the upper flat portion 150*e* of the heat sink 150, as shown in FIG. 13A.

Figure 13B:
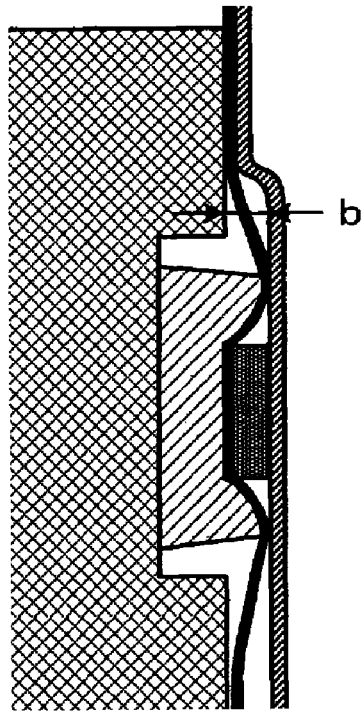

At this time, like in the enlarged view 180*c* of FIG. 7, a distance (a minimum distance) between the supporter 131*g* (and more specifically the opposing face 131*l*) and the heat sink 150 (and more specifically the flat protrusion 150*a*) is adjusted to not smaller than b, as shown in FIG. 13B. For example, a protruding amount of the flat protrusion 150*a* from the flat portion 150*e* and the lower flat portion 150*f* is set at b or larger. Further, a distance between the two opposing faces 131*i* and 131*l* may be set at such a distance that, even when the opposing face 131*l* and the flat portion 150*e* are in contact, compressive deformation of the elastic member 161 does not reach its limit yet and therefore there is some allowance left for deformation.

Here, when external force is applied to the heat sink 150, the driver IC 160 can be more surely prevented from receiving damaging force because there are not only the restricting portion 131*a* provided in the second location but also a contact portion between the opposing face 131*l* and the flat portion 150*e* which exists near the driver IC 160. In this construction, when receiving external force, the restricting portion 131*a* firstly comes into contact with the heat sink 150. Subsequently, depending on intensity of the external force, a second step may follow. That is, contact may occur at the contact portion between the opposing face 131*l* and the flat portion 150*e*.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head comprising:

a passage unit that has a nozzle and in which an ink passage communicating with the nozzle is formed;

an ejection actuator that ejects, from the nozzle, ink contained in the ink passage formed in the passage unit;

a driver chip that supplies to the ejection actuator a signal for driving the ejection actuator;

a flat plate member that is in contact with the driver chip;

an elastic member that biases the driver chip to the flat plate member;

a support member that supports the elastic member and cooperates with the flat plate member to sandwich the driver chip therebetween at a first location with interposition of the elastic member in a particular direction; and a restricting portion provided on at least either one of the support member and the flat plate member in a second location which is different from the first location, the restricting portion is positioned such that a distance in the particular direction between the restricting portion and the other one of the support member and the flat plate member at the second location is less than a distance in the particular direction between the support member and the flat plate member at the first location, wherein the restricting portion is configured to prevent the distance between the flat plate member and the support member in the first location from becoming equal to or less than a minimum distance which is a distance therebetween in a state when the elastic member is compressed to the maximum limit.

2. The ink-jet head according to claim 1, wherein:

the first location is a location with respect to a longitudinal direction of the passage unit, in which the support member and the flat plate member sandwich the driver chip therebetween;

and the second location is a location different from the first location with respect to the longitudinal direction of the passage unit.

3. The ink-jet head according to claim 1, wherein the distance between the support member and the flat plate member in the first location means a length of a shortest route from the support member to the flat plate member within a region in the first location where the support member and the flat plate member are opposed to each other.

4. The ink-jet head according to claim 1, wherein the restricting portion is a protrusion formed, in the second location, on a face of at least either one of the flat plate member and the support member which is opposed to the other of the flat plate member and the support member.

5. The ink-jet head according to claim 4, wherein the flat plate member and the support member are disposed in such a manner that, when external force is not applied to the flat plate member, a distance therebetween in the second location is less than A minus B, where A represents a distance between the flat plate member and the support member in the first location when external force is not applied to the flat plate member, and B represents a distance between the flat plate member and the support member in the first location when external force is applied to the flat plate member to thereby compress the elastic member to the maximum limit so that the driver chip and the support member are separated by a minimum distance.

6. The ink-jet head according to claim 5, wherein the distance between the support member and the flat plate member in the second location is the minimum distance between the support member and the flat plate member where the support member and the flat plate member are opposed to each other.

7. The ink-et head according to claim 5, wherein the flat plate member includes:

a first flat portion and a second flat portion that extend along two parallel planes, respectively; and a bent portion that connects the first flat portion and the second flat portion to each other.

8. The ink-jet head according to claim 7, wherein the flat plate member includes:

a surface that is formed in parallel with a plane crossing the passage unit;

a first flat portion and a second flat portion that, when viewed in a cross section sectioned along a plane extending perpendicularly to the surface and crossing the passage unit, have no common region with each other and extend linearly in a direction away from the passage unit; and a bent portion that connects the first flat portion and the second flat portion to each other and, when viewed in the cross section, is bent at one end of the first flat portion to a direction away from the support member, then further bent toward the second flat portion, and then reaches to one end of the second flat portion.

9. The ink-jet head according to claim 1, wherein, when external force is not applied to the flat plate member, the flat plate member and the support member are spaced apart from each other in the second location.

10. The ink-jet head according to claim 4, wherein:

the support member and the flat plate member are elongated along one direction; and on a face of either one of the flat plate member and the support member which is opposed to the other of the flat plate member and the support member, the driver chip and a plurality of the protrusions are disposed alternatingly along the one direction.

11. The ink-jet head according to claim 1, wherein:

the passage unit has a face different from the ink ejection face and parallel to the ink ejection face, and also has a recess opened on the different face;

a projection fittable in the recess is formed on the flat plate member; and the projection is fitted in the recess.

12. The ink-jet head according to claim 1, further comprising an ink reservoir having an ink supply port and opposed to a surface of the passage unit, wherein:

an actuator unit including a plurality of the ejection actuators is bonded to a region of the surface of the passage unit opposed to the ink reservoir;

the passage unit has an ink supply port that communicates with the ink supply port of the ink reservoir and that is formed in a region of the surface of the passage unit to which the actuator unit is not bonded; and the support member is formed integrally with the ink reservoir.

13. The ink-jet head according to claim 1, wherein the flat plate member is made of a material having thermal conductivity higher than that of air.

14. The ink-jet head according to claim 13, wherein the flat plate member is made of a metal material.

* * * * *